US010259095B2

(12) United States Patent
Yagur et al.

(10) Patent No.: US 10,259,095 B2
(45) Date of Patent: Apr. 16, 2019

(54) METHOD AND APPARATUS FOR TREATING A FLOOR SURFACE WITH ZERO-TOLERANCE EDGING

(71) Applicants: Ron Yagur, Lake Mary, FL (US); Patrick Pollitt, Orlando, FL (US)

(72) Inventors: Ron Yagur, Lake Mary, FL (US); Patrick Pollitt, Orlando, FL (US)

( * ) Notice: Subject to any disclaimer, the term of this patent is extended or adjusted under 35 U.S.C. 154(b) by 0 days.

(21) Appl. No.: 15/499,475

(22) Filed: Apr. 27, 2017

(65) Prior Publication Data

US 2017/0334032 A1 Nov. 23, 2017

Related U.S. Application Data

(60) Provisional application No. 62/328,069, filed on Apr. 27, 2016.

(51) Int. Cl.

| | |
|---|---|
| ***B24B 7/18*** | (2006.01) |
| ***B24B 7/22*** | (2006.01) |
| ***B24B 47/12*** | (2006.01) |
| ***B24B 41/047*** | (2006.01) |
| ***B24B 27/00*** | (2006.01) |

(52) U.S. Cl.

CPC ..... *B24B 7/18* (2013.01); *B24B 7/22* (2013.01); *B24B 27/0007* (2013.01); *B24B 41/047* (2013.01); *B24B 47/12* (2013.01)

(58) Field of Classification Search

CPC ..... B24B 7/18; B24B 7/22; B24B 27/0007; B24B 41/07

USPC ..... 451/353

See application file for complete search history.

(56) References Cited

U.S. PATENT DOCUMENTS

| | | | | |
|---|---|---|---|---|
| 3,026,655 | A | 3/1962 | Osenberg | |
| 3,124,911 | A | 3/1964 | Vinella | |
| 3,169,262 | A | 2/1965 | Etal | |
| 3,701,221 | A | 10/1972 | Vinella | |
| 3,934,377 | A | 1/1976 | Tertinek | |
| 4,918,872 | A | 4/1990 | Sato | |
| 5,054,245 | A | 10/1991 | Coty | |
| 5,247,765 | A | 9/1993 | Quintana | |
| 5,480,258 | A | 1/1996 | Allen | |
| 5,567,503 | A | 10/1996 | Sexton | |
| 5,605,493 | A | 2/1997 | Donatelli | |
| 5,890,833 | A | 4/1999 | Allen | |
| 5,911,620 | A | 6/1999 | Spangenberg | |
| 6,299,522 | B1 | 10/2001 | Lee | |
| 6,494,773 | B1 * | 12/2002 | Marchini | B24B 7/186 144/115 |
| 6,786,556 | B2 | 9/2004 | Due | |
| 6,814,657 | B2 | 11/2004 | Spangenberg | |
| 7,104,739 | B2 | 9/2006 | Lagler | |

(Continued)

*Primary Examiner* — George B Nguyen

(74) *Attorney, Agent, or Firm* — John L. DeAngelis; Beusse Wolter Sanks & Maire PLLC

(57) ABSTRACT

A method and apparatus is provided for treating a floor surface with zero-tolerance edging. The apparatus includes a frame and wheels mounted to the frame so the frame can travel over the floor surface. The apparatus also includes a motor mounted to the frame and a head assembly including a bottom plate. The bottom plate is operatively coupled to the motor so that the bottom plate is configured to rotate about a first axis. The bottom plate is positioned such that a tooling plate mounted to the bottom plate is configured to treat the floor surface including an edge of the floor surface intersecting a wall surface.

17 Claims, 30 Drawing Sheets

(56) References Cited

U.S. PATENT DOCUMENTS

| | | | | |
|---|---|---|---|---|
| 7,137,876 | B2 * | 11/2006 | Immordino, Jr. | B24B 7/186 451/353 |
| 7,247,085 | B1 * | 7/2007 | Anderson | A47L 11/162 15/340.1 |
| 7,563,156 | B2 * | 7/2009 | Anderson | B24B 7/186 451/353 |
| 7,775,741 | B2 | 8/2010 | Copoulos | |
| 8,172,649 | B2 | 5/2012 | Mann, Jr. | |
| 8,282,445 | B2 * | 10/2012 | Goldberg | A47L 11/16 451/350 |
| 8,464,420 | B2 | 6/2013 | Ye | |
| 8,684,796 | B2 | 4/2014 | McCutchen | |
| 8,839,479 | B2 * | 9/2014 | Hruby | A47L 11/1625 15/49.1 |
| 8,888,564 | B1 * | 11/2014 | Wood | B24B 7/186 451/350 |
| 9,145,650 | B2 * | 9/2015 | LeBlanc | E01C 19/43 |
| 9,862,067 | B2 * | 1/2018 | Winterfjord | B24B 7/186 |
| 2005/0124270 | A1 * | 6/2005 | Palushi | B24B 7/186 451/353 |
| 2013/0189908 | A1 | 7/2013 | Strickland | |
| 2014/0227949 | A1 * | 8/2014 | Popov | B24B 7/186 451/353 |
| 2015/0196183 | A1 * | 7/2015 | Clark | A47L 11/14 451/353 |
| 2016/0031061 | A1 * | 2/2016 | Truong | B24B 47/12 451/353 |

* cited by examiner

METHOD AND APPARATUS FOR TREATING A FLOOR SURFACE WITH ZERO-TOLERANCE EDGING

CROSS-REFERENCE TO RELATED APPLICATIONS

This application claims benefit of Provisional Application No. 62/328,069, filed Apr. 27, 2017, the entire contents of which are hereby incorporated by reference as if fully set forth herein, under 35 U.S.C. § 119(e).

BACKGROUND

Concrete grinding refers to a method that uses a machine equipped with metal bond diamonds for grinding the concrete floor, beginning with a lower grit diamond and working toward higher grit diamond to smooth and tighten the concrete floor.

Concrete polishing continues from the last highest grit metal bond diamond that was used and involves tooling made from resin bond diamonds. The difference between metal and resin bond tooling is that the diamonds in the metal bond are held together in a matrix composed of an assortment of metal elements such as copper, tin, iron, etc and diamonds in the resin bond are held together in a matrix composed of resin material. Concrete polishing is a process by which the floor is honed from a low grit to as high a grit as desired to produce an extremely smooth floor that if so desired can shine like a mirror as higher resin diamond grits are used.

The burnishing process utilizes burnishing pads that for the most part help remove wax or other similar chemicals from a floor using a stripping pad or similar pad and in turn reapply the wax or other chemicals using a variety of burnishing pads, by melting the material into the floor using a burnishing pad that rotates at high speed thereby creating heat and melting and driving the material into the tiny pores of the concrete floor. Burnishing pads are also available with various diamond grits impregnated into the pad which at times can remove some of the resin bond diamond polishing process or bring back to life a polished concrete floor that has lost its shine.

SUMMARY

In a first set of embodiments, an apparatus is presented for treating a floor surface with zero-tolerance edging. The apparatus includes a frame and a pair of wheels mounted to the frame so that the frame is configured to travel of the floor surface. The apparatus also includes a motor mounted to the frame. The apparatus also includes a head assembly including a bottom plate, where the bottom plate is operatively coupled to the motor so that the bottom plate is configured to rotate about a first axis. The bottom plate is positioned such that a tooling plate mounted to the bottom plate is configured to treat the floor surface including an edge of the floor surface intersecting a wall surface.

In a second set of embodiments, an apparatus is presented for treating a floor surface. The apparatus includes a frame including an upper frame and a lower frame and a pair of wheels mounted to the lower frame so that the frame is configured to travel over a floor surface. A motor is mounted to the upper frame. A head assembly is mounted to the upper frame and includes a bottom plate that is operatively coupled to the motor so that the bottom plate is configured to rotate about a first axis. A tooling plate is mounted to the bottom plate and is configured to treat the floor surface upon rotation of the bottom plate about the first axis. The upper frame and the lower frame are pivotally coupled about a pivot axis and the upper frame is configured to be pivoted relative to the lower frame so that the bottom plate is oriented parallel to the floor surface.

In a third set of embodiments, a method is presented for treating a floor surface with zero-tolerance edging. The method includes treating the floor surface with a tooling plate mounted to the bottom plate based on the rotation of the bottom plate about the first axis, where the treating step extends to an edge of the floor surface interesting with a wall surface based on the displacement of the bottom plate and the tool plate.

Still other aspects, features, and advantages are readily apparent from the following detailed description, simply by illustrating a number of particular embodiments and implementations, including the best mode contemplated for carrying out the invention. Other embodiments are also capable of other and different features and advantages, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

Embodiments are illustrated by way of example, and not by way of limitation, in the figures of the accompanying drawings in which like reference numerals refer to similar elements and in which.

DETAILED DESCRIPTION

Concrete grinders are available as hand tools or large machines mounted on a moveable frame that is wheeled over the surface of the concrete. The grinder can be used on most any concrete surface from a countertop to a large building floor.

Concrete grinders use an abrasive spinning wheel to grind or polish with an abrasive surface of diamond. The use of diamond tooling is the most common type of abrasive used under concrete grinders and it is available in different grits values that range from a 6 grit to the high thousands. The higher range grits are typically used for honing and polishing the concrete surface, as described above.

Concrete is usually ground dry for convenience although a filter-equipped vacuum is needed to capture the fine dust produced. Concrete can also be ground wet in which case no vacuum is used but the clean-up is more difficult.

Grinding machines are usually powered from a single or three-phase supply depending on the availability of power source at the job and/or the country where the work is being done. A variable speed grinding machine motor is an advantageous feature that allows for varying the grinding speed to keep the tooling in contact with the floor.

Figure 1A:
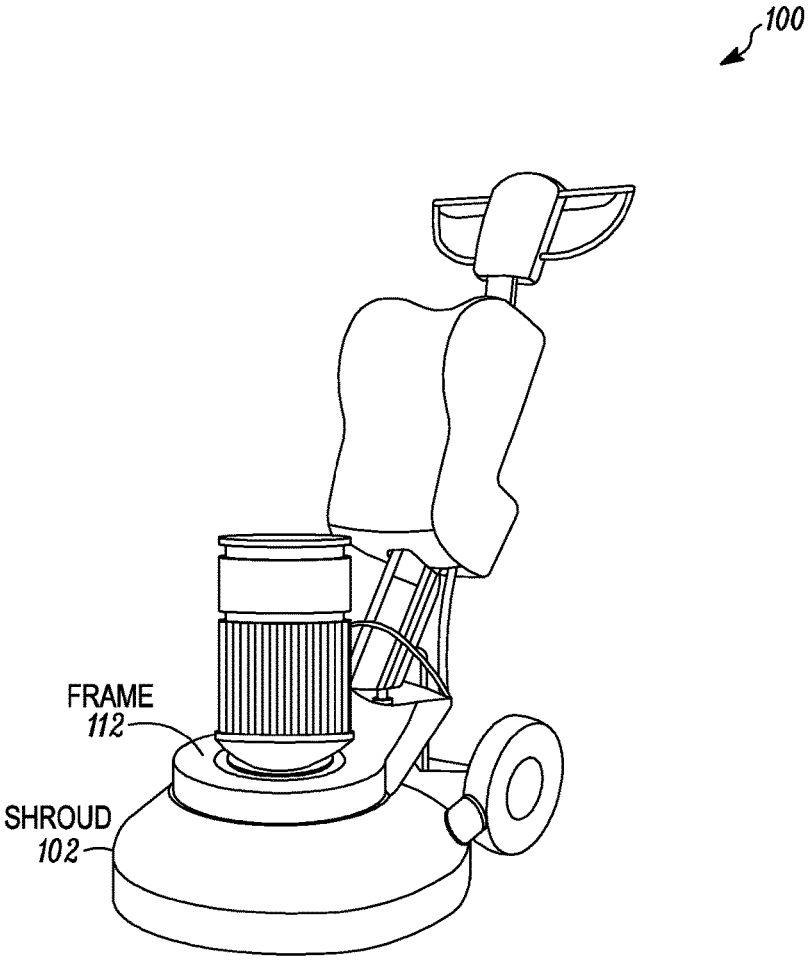
FIG. 1A (PRIOR ART)
FIG. 1A is an image that illustrates an example of a conventional concrete grinder.
Figure 1B:
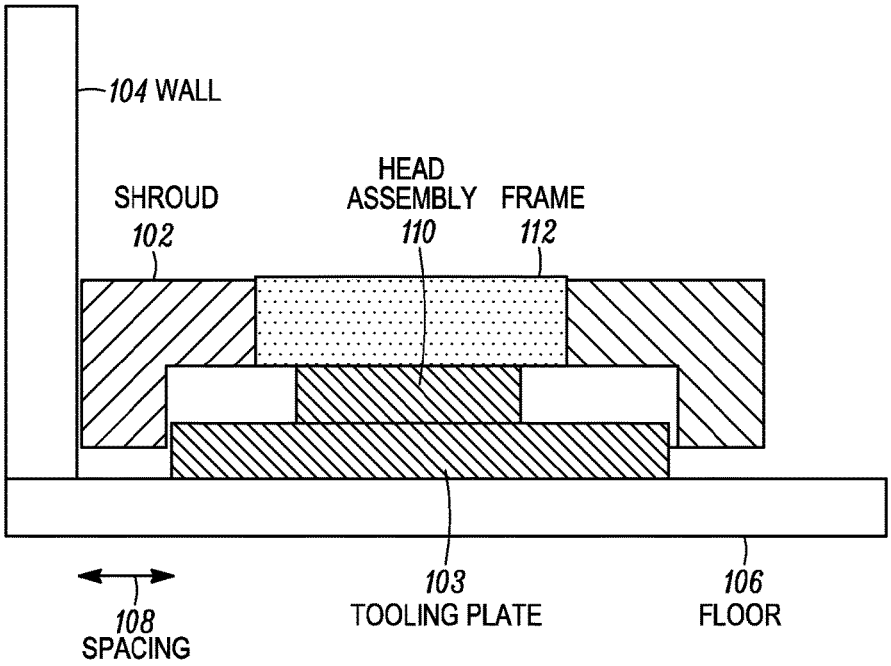
FIG. 1B (PRIOR ART)
FIG. 1B is a block diagram that illustrates an example of a cross-sectional view of the conventional concrete grinder of FIG. 1A at an intersection of a wall and floor surface.

FIG. 1A is an image that illustrates an example of a conventional concrete grinder 100 including a motor mounted on a frame 112 and a shroud 102. FIG. 1B is a block diagram that illustrates an example of a cross-sectional view of the conventional concrete grinder 110 of FIG. 1A at an intersection of a wall 104 and floor 106 surface. The concrete grinder 110 includes a tooling plate 103 that is rotatably mounted to a head assembly 110 that in-turn is mounted to the frame 112. In one embodiment, the tooling plate 103 is a diamond tooling plate. As depicted in FIG. 1B, the tooling plate 103 of the conventional concrete grinder 110 cannot get within a minimum spacing 108 of the wall 104 surface and thus the conventional concrete grinder 110 cannot grind concrete over the minimum spacing 108. This is because the tooling plate 103 and head assembly 110 cannot be moved relative to the frame 112 and instead are operated in a fixed position relative to the frame 112. As a result of this, a hand grinder must be used to grind concrete within the minimum spacing 108.

It is here recognized that conventional concrete grinders 100 have several drawbacks. As previously discussed, conventional concrete grinders 100 are limited as they cannot grind a concrete surface within a minimum spacing 108 of a wall 104. Consequently, hand grinders must be used to grind concrete over the minimum spacing 108. The inventors of the present invention recognized that this introduces two notable drawbacks. First, hand grinding is labor intensive and thus increases the time and cost of performing a project. Second, hand grinding is visually distinctive from machine grinding and thus there is no blending between the grinded concrete in the minimum spacing 108 (hand grinded) and the grinded concrete outside the minimum spacing 108 (machine grinded). Instead, obvious visual boundaries between the hand grinding in the minimum spacing 108 and machine grinding outside the minimum spacing 108 can be seen.

The inventors of the present invention developed an apparatus that overcomes these noted drawback of conventional concrete grinders. In one embodiment, the apparatus is a grinding machine where the head assembly and tooling plate can be displaced in a direction orthogonal to the rotational axis of the tooling plate. In one embodiment, the head assembly and tooling plate can be displaced in a direction orthogonal to the rotational axis of the tooling plate, so that the tooling plate can grind concrete right up to the wall surface. In other embodiments, the apparatus includes a head assembly and tooling plate that is positioned (e.g. the head assembly and tooling plate need not be adjustable in the direction orthogonal to the rotational axis of the tooling plate) such that the tooling plate can grind concrete right up to the wall surface. This advantageously saves costs during a project, as it eliminates the necessity of hand grinding over the minimum spacing 108. Additionally, this advantageously improves the visual blending of the grinding over the floor surface all the way to the wall surface.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements at the time of this writing. Furthermore, unless otherwise clear from the context, a numerical value presented herein has an implied precision given by the least significant digit. Thus a value 1.1 implies a value from 1.05 to 1.15. The term "about" is used to indicate a broader range centered on the given value, and unless otherwise clear from the context implies a broader range around the least significant digit, such as "about 1.1" implies a range from 1.0 to 1.2. If the least significant digit is unclear, then the term "about" implies a factor of two, e.g., "about X" implies a value in the range from 0.5× to 2×, for example, about 100 implies a value in a range from 50 to 200. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Some embodiments of the invention are described below in the context of treating a floor surface. In other embodiments, the invention is described in the context of concrete grinding. In still other embodiments, the invention is described in the context of concrete polishing. In still other embodiments, the invention is described in the context of burnishing. Other embodiments of the invention are described below in the context of scrubbing any surface, sanding wood, screening any surface, scarifying, bush hammers and carbide slicers.

As used herein the term "orthogonal" refers to about 90±20 degrees. In some embodiments, the term "orthogonal" refers to about 90±10 degrees. In other embodiments, the term "orthogonal" refers to about 90±5 degrees.

As used herein the term "treat" or "treating" a floor surface refers to any of concrete grinding, concrete polishing, burnishing or brushing the floor surface. As used herein, the term "tooling plate" refers to any of a metal bond diamond tooling plate, a resin bond diamond tooling plate, a burnishing pad, a quick change plate and a scrub brush.

1. Overview

Figure 2A:
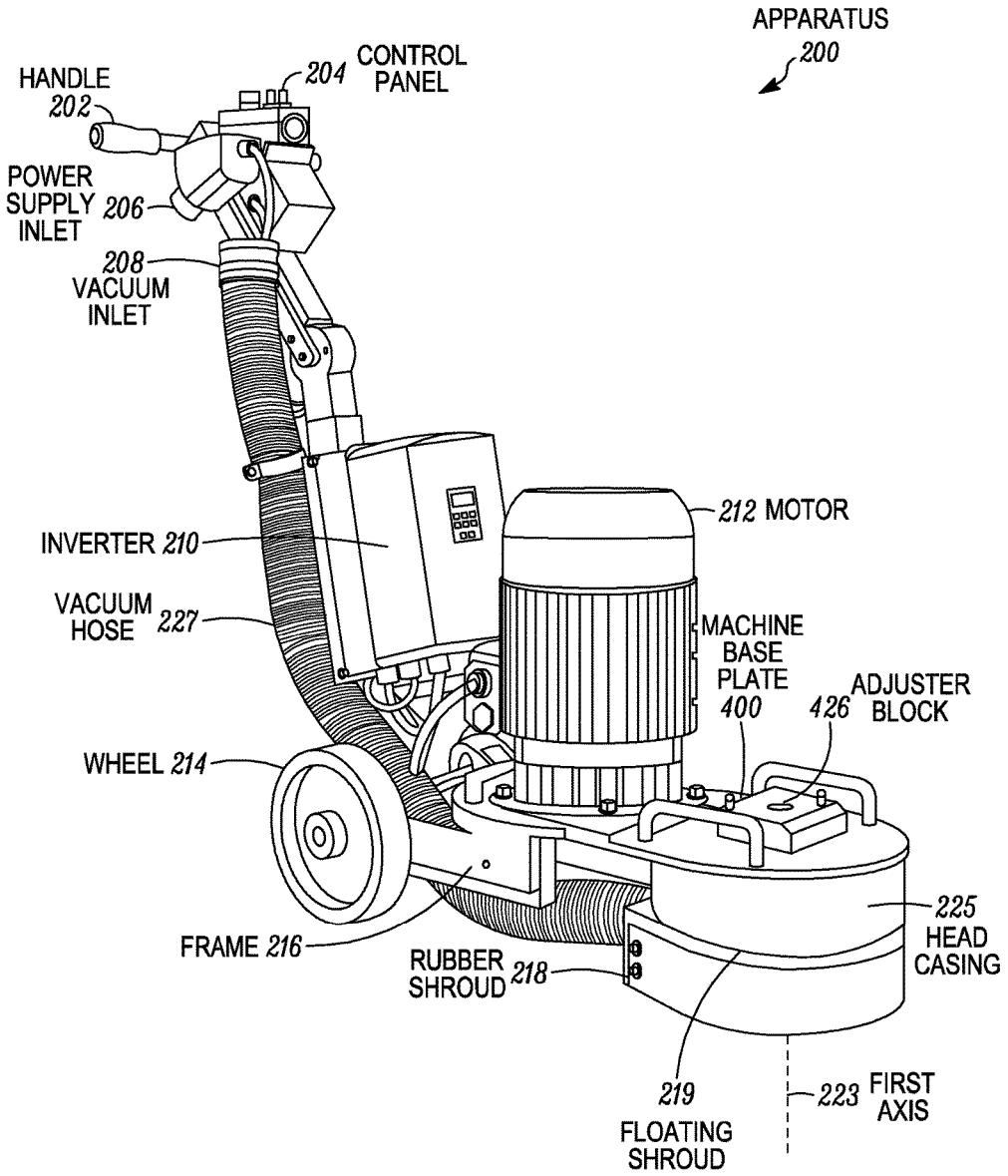
FIG. 2A is an image that illustrates an example of a perspective view of an apparatus for treating a floor surface, according to an embodiment.

FIG. 2A is an image that illustrates an example of a perspective view of an apparatus 200 for treating a floor surface, according to an embodiment. In one embodiment, the apparatus 200 is an all-in-one grinder, polisher, burnisher and zero-tolerance edger. In other embodiments, the apparatus 200 is used to perform one or more of grinding, polishing, burnishing and zero-tolerance edging. In an example embodiment, values of one or more parameters of the apparatus 200 are about the same as the values depicted in Table 1 below:

TABLE 1

| | |
|---|---|
| Model | DDG 1220 |
| Grinding Diameter | 292 mm (11.5")/490 mm (19.25") |
| Grinding Plate Diameter | 280 mm (11")/476 (18.75") |
| Grinding Plate Speed | 575-1800 RPM |
| Weight | 159 Kg (350 lbs.) |

However, parameter values of the apparatus 200 are not limited to the values listed in Table 1 and include different values for the listed parameters and/or values for different parameters not listed in Table 1. In other embodiments, a length of the apparatus 200 is about 62 inches, a width of the apparatus 200 is about 18 inches and a height of the apparatus 200 is about 47 inches.

In one embodiment, the apparatus 200 includes a frame 216 and a pair of wheels 214 mounted to the frame 216. Additionally, the apparatus 200 includes a motor 212 mounted to the frame 216. In one embodiment, the motor 212 is a variable speed single head grinder with flex head technology powered by Dual Phase (e.g. Single or 3-Phase) or a dedicated 3-Phase motor (e.g. 230 Volt~480 Volt, 7.5 Horsepower 3-phase motor). In an example embodiment, values of one or more parameters of the motor 212 are about the same as the values depicted in Table 2 below:

TABLE 2

| Model | DDG1220W230 | DDG1220W480 | DDG1220W480 | DDG1220D230 |
|---|---|---|---|---|
| Power Supply | 230 V/3 Phase | 440 V/3 Phase | 400 V/3 Phase | 220 V 10 |
| Voltage | 208-240 V | 420-480 V | 380-410 V | 220 V |
| Current | 17.9 A | 8.97 A | 10.5 A | 50 A |
| Frequency | 60 Hz | 60 Hz | 50 HZ | 60 Hz |
| Motor | 5.5 kW (7.5 hp) | 5.5 kW (7.5 hp) | 5.5 kW (7.5 hp) | 5.5 kW (7.5 hp) |

However, parameter values of the motor 212 are not limited to the values listed in Table 2 and include different values for the listed parameters and/or values for different parameters not listed in Table 1. A power supply inlet 206 is connected to an appropriate power supply, based on one or more of the above parameters of the motor 212. In other embodiments, instead of an electrical power source, the motor 212 is powered with a gasoline source (e.g. propane tank) that is mounted to the frame 216. An inverter 210 is also provided between the power supply inlet 206 and the motor 212.

In some embodiments, the apparatus 200 includes a handle 202 to push the apparatus 200 over a floor surface and a control panel 204 to vary one or more operating parameters of the apparatus 200. In one embodiment, the control panel 204 includes a first control to select a rotation direction (e.g. left or right) of the bottom plate 226, a second control to select a rotation speed of the bottom plate 226, a third control to start the apparatus 200 and a fourth control to stop the apparatus 200. In an example embodiment, less or more than these controls are provided in the control panel 204.

Figure 2B:
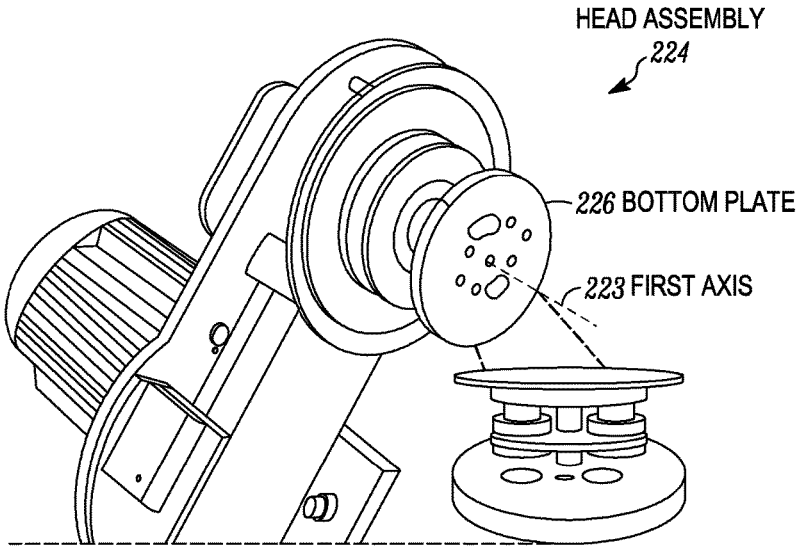
FIG. 2B is an image that illustrates an example of a perspective view of a head assembly of the apparatus of FIG. 2A, according to an embodiment.
Figure 2C:
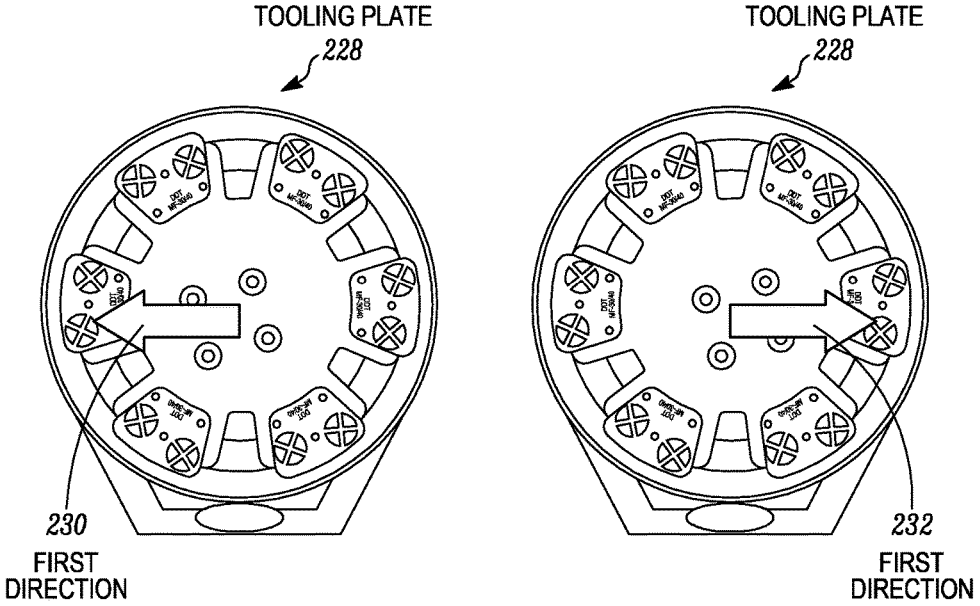
FIG. 2C is an image that illustrates an example of a bottom view of a tooling plate mounted on the bottom plate of FIG. 2B, according to an embodiment.
Figure 2D:
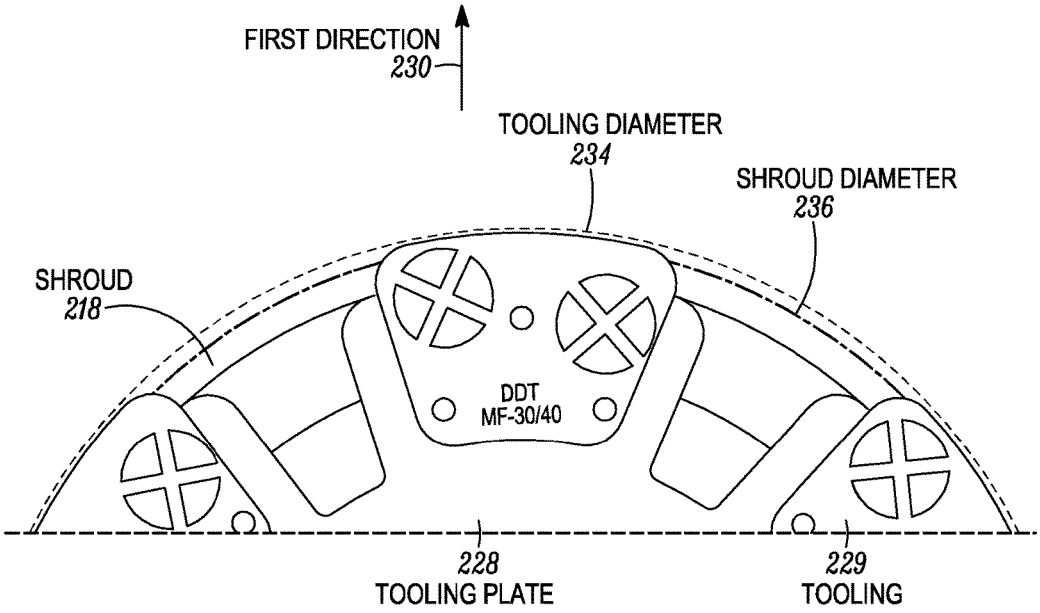
FIG. 2D is an image that illustrates an example of a partial bottom view of the tooling plate of FIG. 2C, according to an embodiment.
Figure 2E:
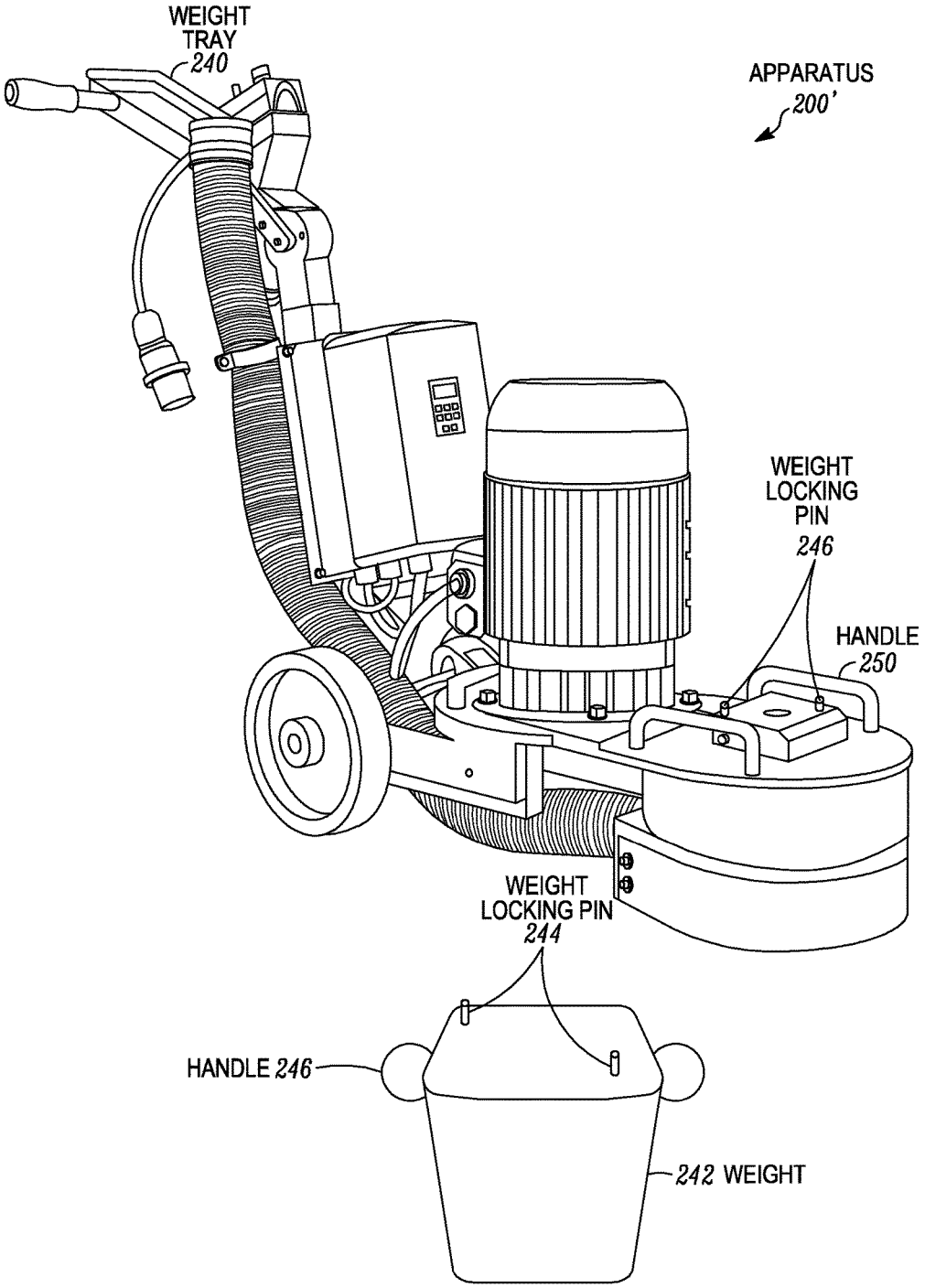
FIG. 2E is an image that illustrates an example of a perspective view of an apparatus for treating a floor surface, according to an embodiment.

FIG. 2E is an image that illustrates an example of a perspective view of an apparatus 200' for treating a floor surface, according to an embodiment. The apparatus 200' is similar to the apparatus 200 of FIG. 2A but further includes one or more weights 242 that can be used to vary the applied weight by the tooling plate 228 on the floor surface. In one example embodiment, the adjuster block 426 includes a pair of weight locking pins 246 that are spaced art to receive the weight 242. In this example embodiment, the weight locking pins 246 of the adjuster block 426 are received in spaced apart slots in a base of the weight 242 to securely fix the weight 242 to the adjuster block 426. Additionally, earth magnets at the base of the weight 242 securely fix the weight 242 to the adjuster block 426 (e.g. steel material). In this example embodiment, the positioning of the weight 242 on the adjuster block 426 increases the applied weight by the tooling plate 228 on the floor surface. In an example embodiment, the weight 242 is about 40 pounds. In an example embodiment, the weight 242 includes weight locking pins 244 that are similar to the weight locking pins 246 on the adjuster block 426 and thus an additional weight 242 can be mounted on top of the first weight 242, to further increase the applied weight by the tooling plate 228 on the floor surface. In some embodiments, more than two weights 242 can be stacked on top of each other. In this example embodiment, where the weight 242 is about 40 pounds, the mounting of two weights 242 on the adjuster block 426 increases the applied weight by about 80 pounds. In an example embodiment, the applied weight by the tooling plate 228 on the floor surface, in an absence of the weights 242 (i.e. due to the frame 216) is about 150 pounds. Example embodiments where a user may want to increase the applied weight by the tooling plate 228 on the floor surface include polishing or grinding glue off the floor surface.

Additionally, as depicted in FIG. 2E, the apparatus 200' includes a weight tray 240 adjacent to the handle 204. The weight tray 240 includes a slot that is sized to receive one or more of the weights 242, to reduce the applied weight of the tooling plate 228 on the floor surface. In one embodiment, the slot of the weight tray 240 is sized so that an inner diameter of the slot is about equal to an outer diameter (e.g. outer width) of the weight 242 and thus the weight 242 is slidably received within the slot. Additionally, in another embodiment, the earth magnets at the base of the weight 242 secure the weight 242 to steel material along the weight tray 240, to securely fix the weight 242 in the weight tray 240. In some embodiments, a lateral position of the weight 242 in the weight tray 240 can be adjusted. In this example embodiment, each inch that the weight 242 is moved in the weight tray 240 varies the applied weight of the weight 242 by a fixed amount (e.g. 5 pounds). In some embodiments, a length of the slot in the weight tray 240 is sufficient to support two weights 242, side-by-side. Example embodiments where a user may want to reduce the applied weight by the tooling plate 228 on the floor surface include using a larger diameter (e.g. 20", 27") tooling plate 228, where a reduction in the applied weight reduces the pressure on the tooling plate 228.

In some embodiments, the apparatus 200 includes a rubber shroud 218 secured around a perimeter of a floating shroud 219. To secure the rubber shroud 218 around the perimeter of the floating shroud 219, in a first step a vacuum hose 227 outlet is secured to a dust port inlet on a floating shroud 219. The floating shroud 219 is then secured around the perimeter of the head casing 225. The rubber dust shroud 218 is then secured on shroud pins of the floating shroud 219. In this example embodiment, the rubber dust shroud 218 is pulled to an opposite side of the floating shroud 219 and secured to shroud pins on the opposite side of the floating shroud 219.

FIG. 2B is an image that illustrates an example of a perspective view of a head assembly 224 of the apparatus 200 of FIG. 2A, according to an embodiment. In one embodiment, the head assembly 224 includes a bottom plate 226 that is operatively coupled to the motor 212 so that the bottom plate 226 rotates about a first axis 223. In an example embodiment, the apparatus 200 is equipped with a single (e.g. 12 inch) bottom plate 226, which is adjustable by design to move left or right (e.g. orthogonal to the first axis 223) in order to get right up against an edge of a wall for zero-tolerance edging. However, the bottom plate 226 need not be adjustable and in some embodiments, the apparatus 200 includes the bottom plate 226 that is positioned at a lateral position relative to the frame 216 such that the tooling plate 228 mounted to the bottom plate 226 can treat the floor surface including an edge of the floor surface intersecting the wall surface. In an example embodiment, the apparatus 226 includes the bottom plate 226 that is in a fixed lateral position relative to the frame 216 such that the tooling plate 228 extends to (or beyond) the shroud 218 and treats the floor surface including an edge of the floor surface intersecting the wall surface.

FIG. 2C is an image that illustrates an example of a bottom view of a tooling plate 228 mounted on the bottom plate 226 of FIG. 2B, according to an embodiment. In an embodiment, where the tooling plate 228 is mounted to the bottom plate 226 by passing screws through holes in the tooling plate 228 and threading the screws into holes in the bottom plate 226. In an example embodiment, the tooling plate 228 is mounted to the bottom plate 226 by threading screws (e.g. four M12×1.75×25 screws) into holes in the bottom plate 226 using a tool (e.g. 8 mm Allen wrench). Based on rotation of the bottom 226, the tooling plate 228 (e.g. metal bond diamond tooling plate, resin bond diamond tooling plate, burnishing pad, scrub brush) also rotates and treats the floor surface (e.g. concrete grinding, concrete polishing, burnishing, brushing, etc) as the apparatus 200 moves over the floor surface.

In some embodiments, the apparatus 200 is configured to displace the bottom plate 226 in a first direction 230 orthogonal to the first axis 223 so that the tooling plate 228 mounted to the bottom plate 226 is also displaced in the first direction 230. In other embodiments, the apparatus 200 is configured to displace the bottom plate 226 in a second direction 232 orthogonal to the first axis 223 so that the tooling plate 228 mounted to the bottom plate 226 is also displaced in the second direction 232.

FIG. 2D is an image that illustrates an example of a partial bottom view of the tooling plate 228 of FIG. 2C, according to an embodiment. In one embodiment, tooling 229 is mounted to the tooling plate 228. In one embodiment, the tooling 229 is a trapezoid plate with a plurality of holes. To install the tooling 229 on the tooling plate 228, the holes of the trapezoid plate are aligned with corresponding holes on the tooling plate 228 and a plurality of screws (e.g. M6×1×14) are screwed through the trapezoid plate holes and into the tooling plate 228 holes with a tool (e.g. 4 mm Allen wrench). In an example embodiment, the trapezoid plate is a diamond tooling plate. In another example embodiment, the tooling 229 is mounted to the tooling plate 228 such that an outer diameter of the tooling 229 extends beyond an outer diameter of the tooling plate 228.

In some embodiments, based on the displacement of the tooling plate 228 in the first direction 230 (FIG. 2C), the tooling plate 228 and/or the tooling 229 are displaced such that a diameter 234 of the tooling plate 228 and/or the tooling 229 extends beyond a diameter 236 of the shroud 218. In an example embodiment, as depicted in FIG. 2D, the diameter 234 of the tooling 229 extends beyond the diameter 236 of the shroud 218. In other embodiments, the diameter of the tooling plate extends beyond the diameter of the shroud 218.

Figure 3A:
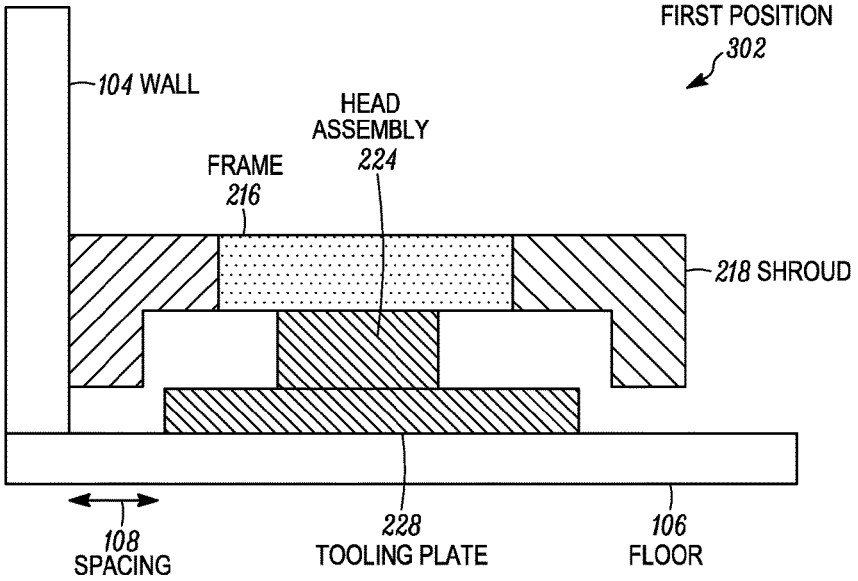
FIG. 3A is a block diagram that illustrates an example of a cross-sectional view of the apparatus of FIG. 2A in a first position at an intersection of a wall and floor surface, according to an embodiment.

FIG. 3A is a block diagram that illustrates an example of a cross-sectional view of the apparatus 200 of FIG. 2A in a first position 302 at an intersection of a wall 104 and floor 106 surface, according to an embodiment. As depicted in FIG. 3A, in the first position 302 the head assembly 224 and tooling plate 228 are positioned in a centered position relative to the frame 216. Additionally, as depicted in FIG. 3A, an outer diameter of the tooling plate 228 is less than an inner diameter of the shroud 218 and thus the tooling plate 228 does not extend to the shroud 218 or to the wall 104 surface in the first position 302. As with the conventional concrete grinder (FIG. 1B), a minimum spacing 108 is provided between the tooling plate 228 and the wall 104 surface.

Figure 3B:
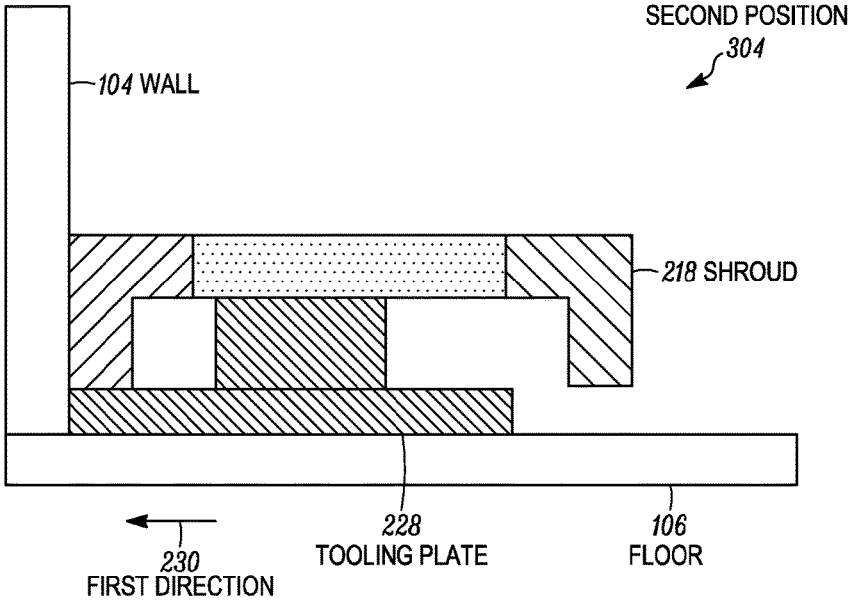
FIG. 3B is a block diagram that illustrates an example of a cross-sectional view of the apparatus of FIG. 2A in a second position at an intersection of a wall and floor surface, according to an embodiment.

FIG. 3B is a block diagram that illustrates an example of a cross-sectional view of the apparatus of FIG. 2A in a second position 304 at an intersection of a wall 104 and floor 106 surface, according to an embodiment. In one embodiment, the second position 304 is based on displacing the head assembly 224 (e.g. bottom plate 226) and tooling plate 228 in the first direction 230 (FIGS. 2C-2D). As a result, the tooling plate 228 extends to the shroud 218 and up against the wall 104 surface. Consequently, the tooling plate 228 achieves zero-tolerance edging, where the tooling plate 228 can treat the floor 106 right up to an intersection with the wall 104 surface. In other embodiments, the apparatus 200 includes the head assembly 224 (e.g. bottom plate 226) and tooling plate 228 that are fixed in the second position 304. In an example embodiment, the bottom plate 226 and tooling plate 228 are permanently fixed in the second position 304 and thus in this example embodiment, the apparatus 200 is dedicated to treatment of the edge of the floor 106 intersecting with the wall 104 surface.

Figure 4A:
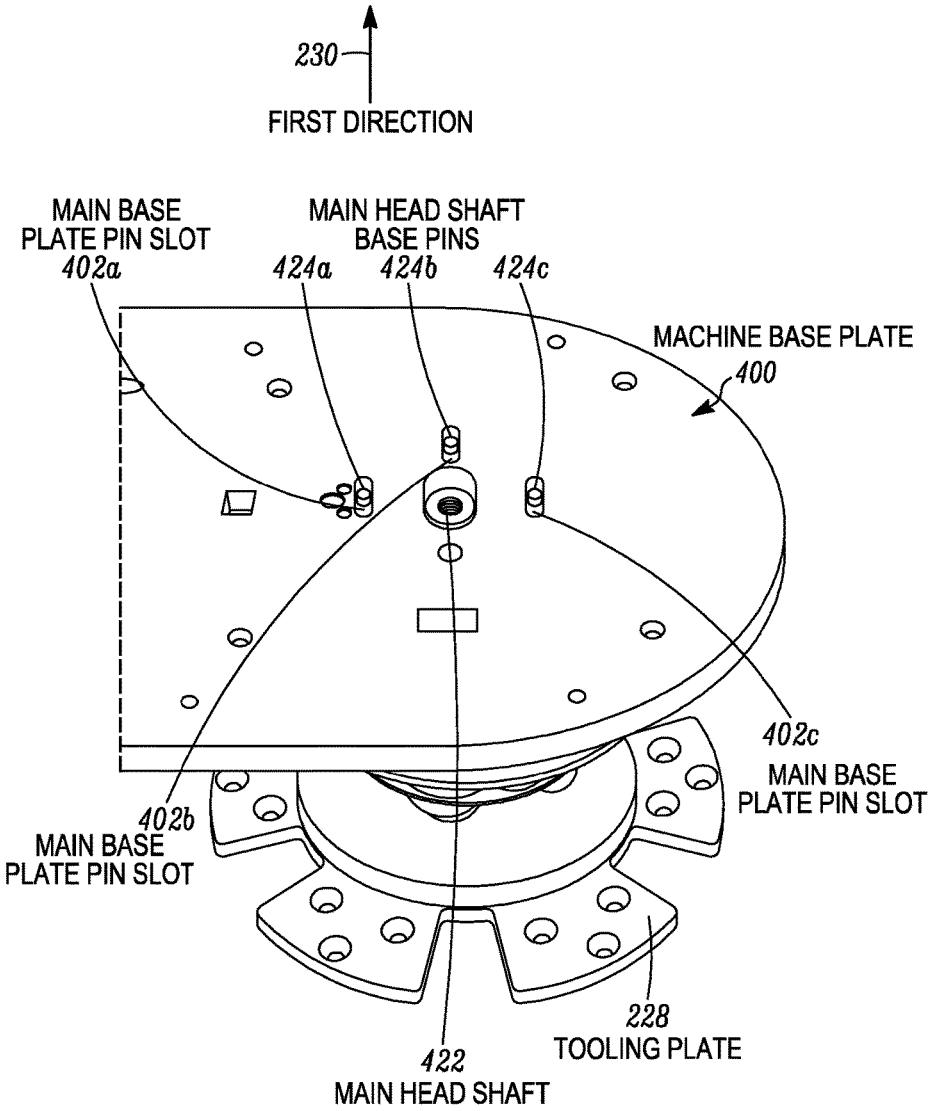
FIG. 4A is an image that illustrates an example of a top perspective view of a machine base plate of the frame of the apparatus of FIG. 2A, according to an embodiment.

FIG. 4A is an image that illustrates an example of a top perspective view of a machine base plate 400 of the frame 216 of the apparatus 200 of FIG. 2A, according to an embodiment. In one embodiment, the machine base plate 400 includes a main head shaft slot 404 and pin slots 402*a*, 402*b*, 402*c*. In an example embodiment, the slots 402*a*, 402*b*, 402*c*, 404 are aligned in the first direction 230, such that a long dimension of the slots is parallel to the first direction 230 and a short dimension of the slots is orthogonal to the first direction 230. In an example embodiment, the main head shaft slot 404 has a long dimension of about 44.5 mm and a short dimension of about 25.3 mm. In an example embodiment, the slots 402*a*, 402*b*, 402*c* each have a long dimension of about 27.8 mm and a short dimension of about 7.9 mm.

Figure 4B:
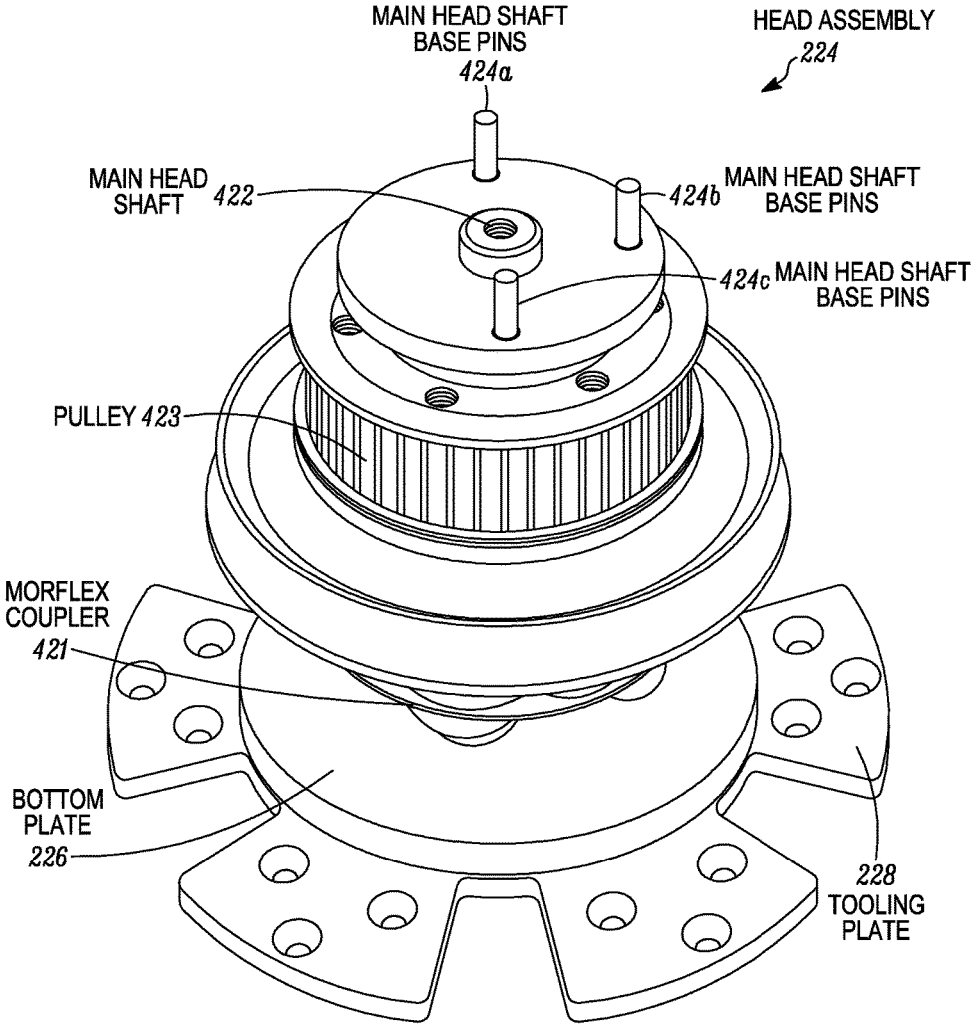
FIG. 4B is an image that illustrates an example of a perspective view of a head assembly of the apparatus of FIG. 2A, according to an embodiment.

FIG. 4B is an image that illustrates an example of a perspective view of a head assembly 224 of the apparatus 200 of FIG. 2A, according to an embodiment. The head assembly 224 includes the bottom plate 226. In some embodiments, the tooling plate 228 mounted to the bottom plate 226 is not considered part of the head assembly 224 nor part of the apparatus 200. As further depicted in FIG. 4B, the head assembly 224 includes a main head shaft 422 and mean head shaft base pins 424*a*, 424*b*, 424*c*. In an example embodiment, the height of the main head shaft 422 is about 10 mm and a height of the main head shaft base pins 424*a*, 424*b*, 424*c* is about 20 mm. Additionally, in some embodiments, the head assembly 224 includes a MORFLEX® coupler 421 supplied by Regal Beloit Americas, Inc. Florence, Ky. In an example embodiment, the MORFLEX® coupler 421 compensates for undulations in the floor surface by permitting the bottom plate 226 to tilt over a range of angles (e.g. 1.5 to 10 degrees) and remain square to the floor over such undulations. Additionally, in some embodiments, the head assembly 224 includes a pulley 423 where a belt driven by the motor 212 is wrapped around the pulley to rotatably couple the head assembly 224 to the motor 212.

Figure 4C:
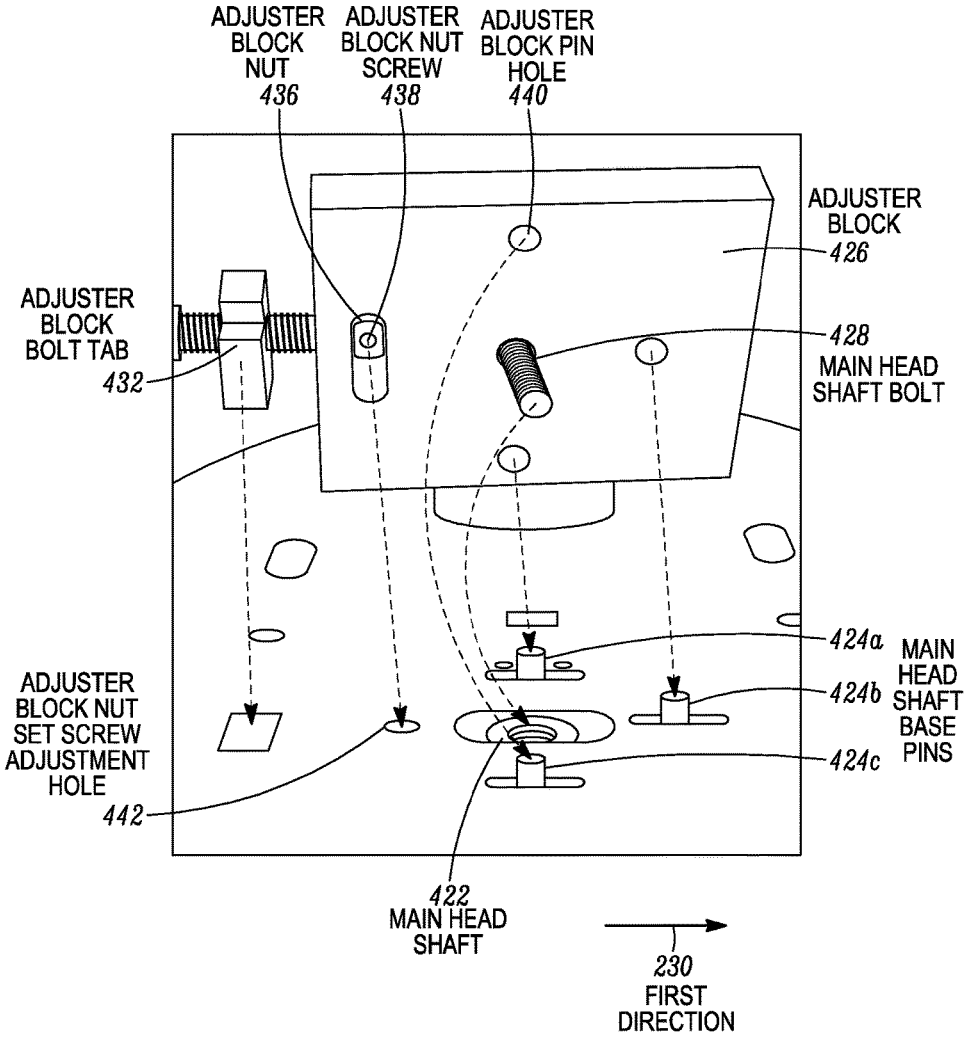
FIG. 4C is an image that illustrates an example of an exploded view of the adjuster block and the machine base plate of FIG. 4D, according to an embodiment.

FIG. 4C is an image that illustrates an example of an exploded view of an adjuster 426 block and the machine base plate 400 of FIG. 4A, according to an embodiment. In some embodiments, the head assembly 224 of FIG. 4B is positioned underneath the machine base plate 400 of FIG. 4A. The main head shaft 422 is received in the main head shaft slot 404 and main head shaft base pins 424*a*, 424*b*, 424*c* are received in the pin slots 402*a*, 402*b*, 402*c*. In one embodiment, the main head shaft slot 404 is configured to slidably receive the main head shaft 422 so that the main head shaft 422 can be displaced in the first direction 230. Additionally, when the main head shaft 422 is displaced in the first direction 230, the bottom plate 226 (and tooling plate 228) is displaced in the first direction 230. In an example embodiment, the main head shaft slot 404 is so configured based on the alignment of the long dimension of the main head shaft slot 404 in the first direction 230.

In one embodiment, the machine base plate pin slots 402*a*, 402*b*, 402*c* are configured to slidably receive the main head shaft base pins 424*a*, 424*b*, 424*c* so that the main head shaft base pins 424*a*, 424*b*, 424*c* can be displaced in the first direction 230. Additionally, when the main head shaft base pins 424*a*, 424*b*, 424*c* are displaced in the first direction 230, the bottom plate 226 (and tooling plate 228) is displaced in the first direction 230. In an example embodiment, the machine base plate pin slots 402*a*, 402*b*, 402*c* are so configured based on the alignment of the long dimension of the slots 402*a*, 402*b*, 402*c* in the first direction 230.

Figure 4D:
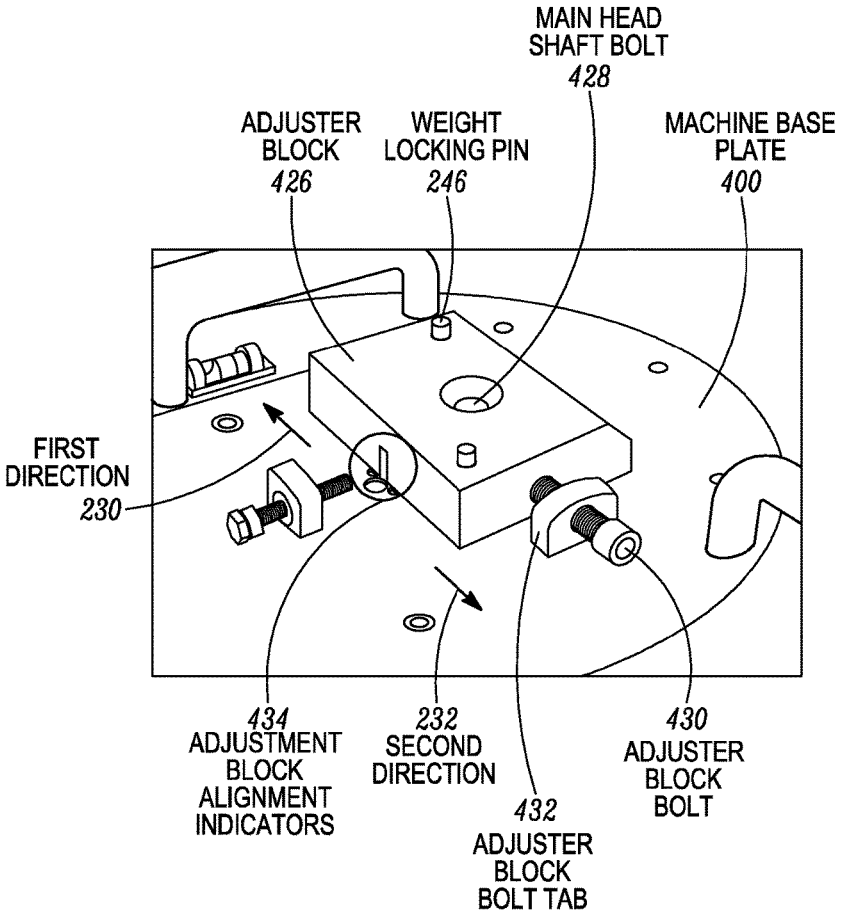
FIG. 4D is an image that illustrates an example of a perspective view of an adjuster block mounted on the machine base plate of FIG. 4A, according to an embodiment.

FIG. 4D is an image that illustrates an example of a perspective view of an adjuster block 426 mounted on a surface the machine base plate 400 of FIG. 4A, according to an embodiment. In some embodiments, a main head shaft bolt 428 is provided to secure the adjuster block 426 to the main head shaft 422 (FIG. 4C) so that the main head shaft 422 is configured to displace in the first direction 230 (e.g. along the main head shaft slot 404) upon displacement of the adjuster block 426 in the first direction 230. In some embodiments, the main head shaft bolt 428 is initially tightened, which prevents displacement of the adjuster block 426 along the machine base plate 400 and thus prevents displacement of the main head shaft 422 in the first direction 230. In these embodiments, the main head shaft bolt 428 is slightly loosened (e.g. ½ to ¾ turn) after which the adjuster block 426 can be displaced along the surface of the machine base plate 400, resulting in displacement of the main head shaft 422. In some embodiments, an adjuster block bolt 430 is operatively connected to the adjuster block 426 so that the adjuster block 426 displaces in the first direction 230 upon rotation of the adjuster block bolt 430 in a clockwise direction and the adjuster block 426 displaces in the second direction 232 upon rotation of the adjuster block bolt 430 in a counterclockwise direction. In another embodiment, the adjuster block bolt 426 is displaced in the first direction upon rotation of the adjuster block bolt 430 in the counterclockwise direction and the adjuster block 426 is displaced in the second direction 232 upon rotation of the adjuster block bolt 430 in the clockwise direction.

Although the adjuster block bolt 430 is depicted and discussed as one embodiment in which the adjuster block 426 could be displaced in the first direction 230 or second direction 232, the embodiments of the present invention is not limited to this arrangement and includes all arrangements know to one of ordinary skill in the art to displace the adjuster block 426 in the first direction 230 or second direction 232. In one example embodiment, after slightly loosening (e.g. ½-¾ turn) the main head shaft bolt 428, a motor (e.g. linear actuator) could be used to displace the adjuster block 426 in the first direction 230 or second direction 232. In this example embodiment, the motor could be mounted to the machine base plate 400 and operatively coupled to the adjuster block 426 so that the adjuster block 426 is displaced in the first direction 230 or second direction 232. In another example embodiment, after slightly loosening the main head shaft bolt 428, the user can displace the machine base plate 400 relative to the head assembly 224 by moving a handle 250 (FIG. 2E) of the machine base plate 400 in the first direction 230 or the second direction 232. In this example embodiment, movement of the handle 250 in the first direction 230 or second direction 232 causes displacement of the machine base plate 400 in the first direction 230 (or second direction 232) relative to the head assembly 224 and thus results in (relative) displacement of the bottom plate 226 in the first direction 230 or second direction 232. In some embodiments, the adjuster block bolt 430 is M12×1.75×60 sized bolt and the main head shaft bolt 428 is M12×1.75×35 size bolt. In an example embodiments, both of the adjuster block bolts 430 and the main head shaft bolt 428 can be adjusted using the same tool (e.g. 10 mm Allen wrench).

In some embodiments, FIG. 4D depicts an adjuster block bolt tab 432 mounted to the machine base plate 400. In one embodiment, the adjuster block bolt tab 432 is welded to the machine base plate 400. In other embodiments, the adjuster block bolt tab 432 is mounted to the machine base plate 400 using mounting tabs 433 (FIG. 4E) on either side of the adjuster block bolt tab 432, where each mounting tab 433 includes an opening 435 to pass a bolt to mount the adjuster block bolt tab 432 to the machine base plate 400. In one embodiment, the adjuster block bolt tab 432 includes an opening to rotatably mount the adjuster block bolt 430. The adjuster block bolt tab 432 advantageously permits the user to conveniently turn the adjuster block bolt 430 (e.g. using a tool) without having to physically hold the adjuster block bolt 430 while turning the adjuster block bolt 430.

Figure 4E:
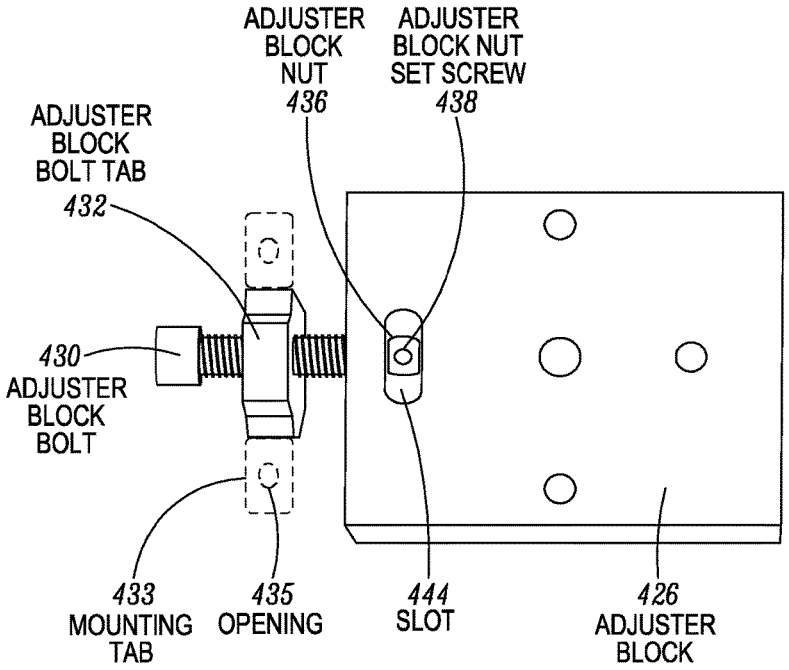
FIG. 4E is an image that illustrates an example of a bottom view of the adjuster block of FIG. 4C, according to an embodiment.

FIG. 4E is an image that illustrates an example of a bottom view of the adjuster block 426 of FIG. 4C, according to an embodiment. In some embodiments, the adjuster block 426 includes a slot 444 that is sized to receive an adjuster block nut 436. The adjuster block bolt 430 is threaded through an opening in one end of the adjuster block 426 and into the adjuster block nut 436 positioned in the slot 444. After the adjuster block bolt 430 has threaded into the slot 444 and into the adjuster block nut 436, the adjuster block bolt 430 is rotatably fixed to the adjuster block nut 436 within the slot 444. By rotatably fixing the adjuster block bolt 430 to the adjuster block nut 436 within the slot 444, rotation of the adjuster block bolt 430 causes the adjuster block 426 to displace in the first direction 230 or second direction 232, depending on the direction of rotation of the adjuster block 430. In one example embodiment, the adjuster block bolt 430 is rotatably fixed to the adjuster block nut 436 using an adjuster block nut set screw 438. In this example embodiment, the adjuster block nut set screw 438 is passed through an opening in the adjuster block nut 436 and into a side of the adjuster block nut 430 within the adjuster block nut 436.

Figure 4F:
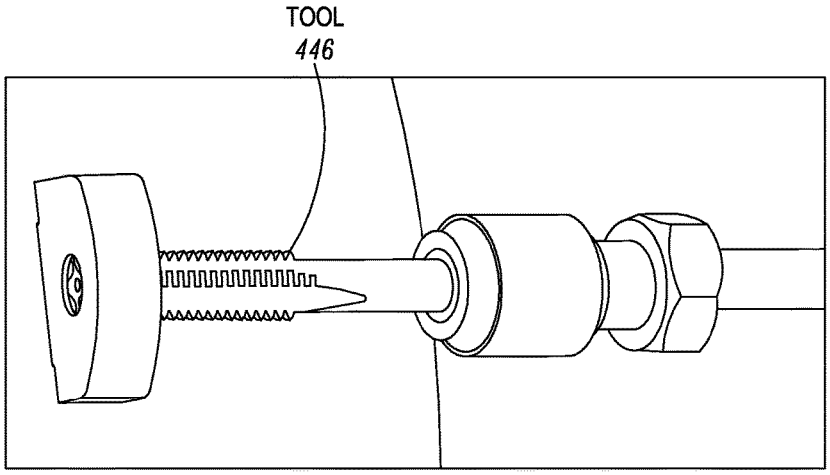
FIG. 4F is an image that illustrates an example of a front view of a tap tool inserted in an adjuster block bolt tab of FIG. 4C, according to an embodiment.
Figure 4G:
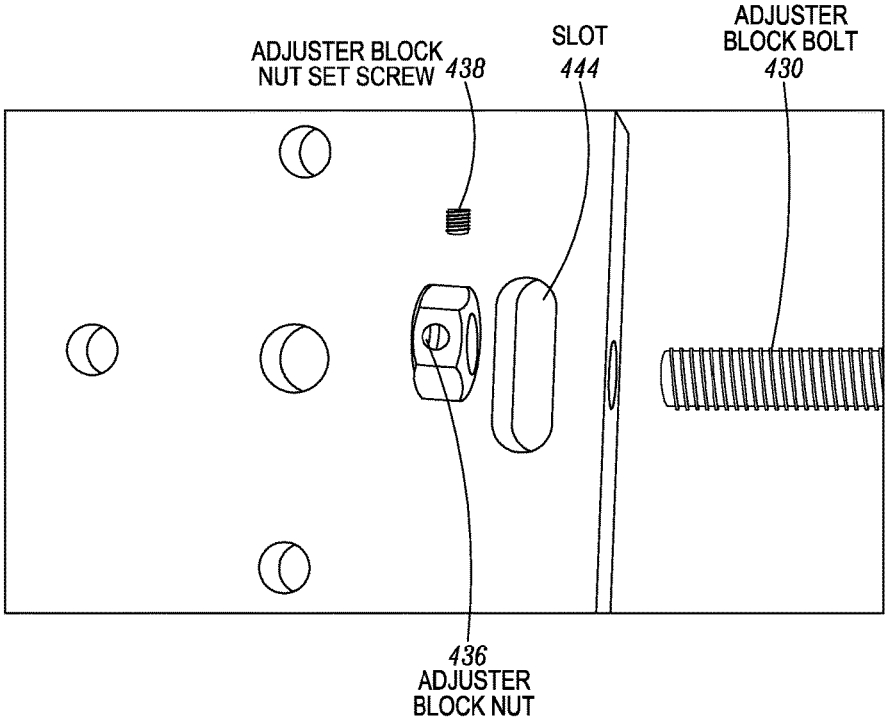
FIG. 4G is an image that illustrates an example of a bottom view of the adjuster block, adjuster block nut and adjuster block nut set screw of FIG. 4D, according to an embodiment.
Figure 4H:
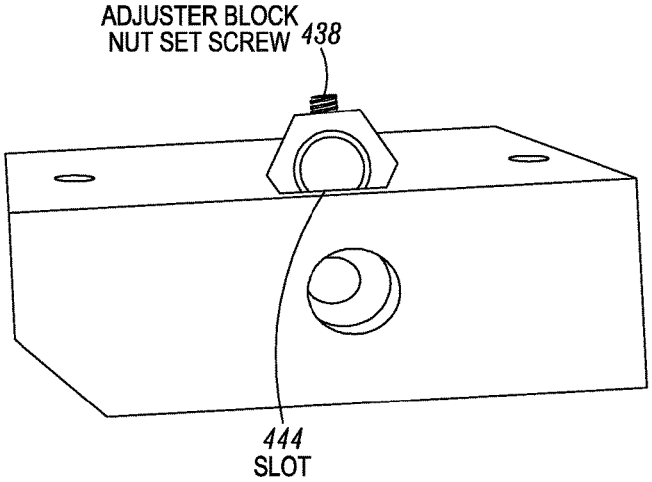
FIG. 4H is an image that illustrates an example of a side view of the adjuster block nut inserted into the slot of the adjuster block, according to an embodiment.
Figure 4I:
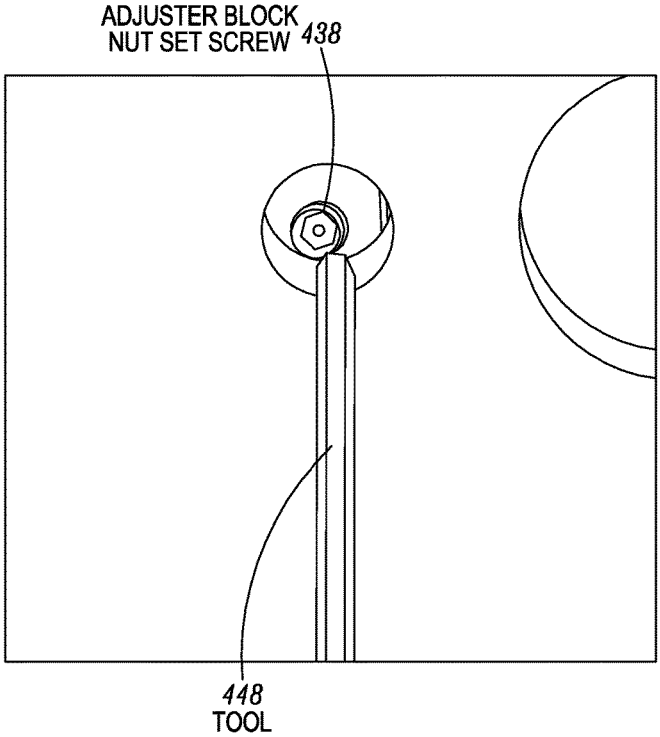
FIG. 4I is an image that illustrates an example of a bottom view of the adjuster block nut set screw in the adjustment hole of FIG. 4D, according to an embodiment.

FIGS. 4F-4I are images that illustrates an example of various stages of installing the adjuster block 426 on the machine base plate 400, including installing the adjuster block nut 436 within the slot 444 of the adjuster block 426. In a first step, the adjuster block bolt tab 432 is welded to the machine base plate 400. In one embodiment, as depicted in FIG. 4F, in a second step, a tool 446 (e.g. a tap) is threaded through the opening of the adjuster block bolt tab 432, to remove zinc build up from the threads of the opening of the adjuster block bolt tab 432. In one embodiment, in a third step, an adhesive (e.g. Loctite®) is applied to the opening of the adjuster block nut 436. In one embodiment, as depicted in FIG. 4H, in a fourth step, the adjuster block nut set screw 438 is positioned in the opening of the adjuster block nut 436 and the adjuster block nut 436 is dropped into the slot 444 of the adjuster block 426. In one embodiment, in a fifth step, the adjuster block 426 is positioned on the surface of the machine base plate 400 as depicted in FIG. 4D so that the adjuster block pin holes 440 are aligned with the machine base plate pin slots 402*a*, 402*b*, 402*c*. In one embodiment, in a sixth step, the adjuster block bolt 430 is threaded into the adjuster block nut 436 in the slot 444 of the adjuster block 426. In an example embodiment, during the sixth step, the adjuster block bolt 430 is threaded until it reaches the end of the slot 444 and is then reversed a partial turn (e.g. ½-¾ turn). In an example embodiment, as depicted in FIG. 4I, during a seventh step, a tool 448 (e.g. Allen wrench) is used to tighten the adjuster block nut set screw 438 into the opening in the adjuster block nut 436 and into the adjuster block bolt 430 to rotatably fix the adjuster block nut 436 to the adjuster block bolt 430.

The method of installing the adjuster block 426 discussed above with reference to FIGS. 4F-4I is merely one example of a method for installing the adjuster block 426. In another embodiment of the method, in a first step the adjuster block bolt 430 is passed through the threaded opening of the adjuster block bolt tab 432. In a second step, the adjuster block bolt 430 is then passed through the adjuster block nut 436 positioned in the slot 444. In a third step, the adjuster block nut set screw 438 is then threaded through the opening of the adjuster block nut 436 and into the adjuster block bolt 430, to rotatably fix the adjuster block bolt 430 to the adjuster block nut 436. In a fourth step, the adjuster block 426 is then mounted to the machine base plate 400 so that the adjuster block pin holes 440 are aligned with the machine base plate pin slots 402*a*, 402*b*, 402*c*. In a fifth step, the adjuster block bolt tab 432 is then mounted to the machine base plate 400 using the mounting tabs 433 (FIG. 4E), where bolts are passed through openings 435 in the mounting tabs 433 and into threaded openings in the machine base plate 400.

Figure 4J:
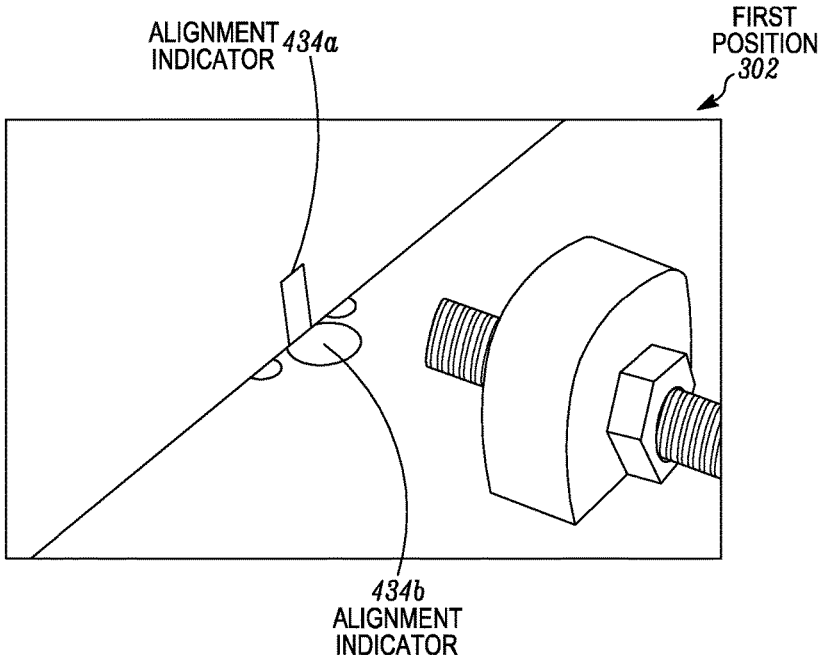
FIG. 4J is an image that illustrates an example of a perspective view of alignment indicators when the apparatus is in the first position of FIG. 3A, according to an embodiment.

In some embodiments, FIG. 4D depicts that adjustment block alignment indicators 434 are provided that are used to indicate when the adjustment block 426 (and consequently the bottom plate 226 and tooling plate 228) are in one of a plurality of positions. FIG. 4J is an image that illustrates an example of a perspective view of alignment indicators 434 when the apparatus 200 is in the first position 302 of FIG. 3A, according to an embodiment. In some embodiments, the first position 302 is defined as a position where the head assembly 224 (including the bottom plate 226) is centered within the shroud and/or is centered relative to the frame 216. In an embodiment, the first position 302 is also defined by the adjuster block 426 being centered on the machine base plate 400. However, the first position 302 is not limited to a position where the head assembly 224 is centered within the shroud or centered relative the frame 216. As depicted in FIG. 4J, the first position 302 is indicated by the alignment indicators 434 based on an alignment indicator 434*a* on the adjustment block 426 being aligned with a center alignment indicator 434*b* on the machine base plate 400.

Figure 4K:
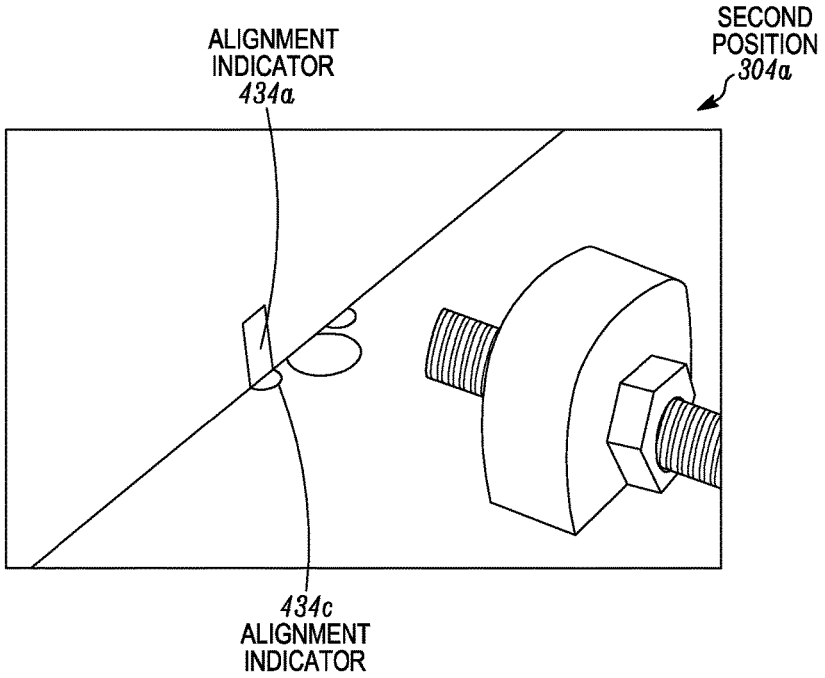
FIG. 4K is an image that illustrates an example of a perspective view of alignment indicators when the apparatus is in the second position of FIG. 3B, according to an embodiment.

As previously discussed, the apparatus 200 is configured to displace the head assembly 224 (e.g. bottom plate 226) and tooling plate 228 from the first position 302 in the first direction 230 to a second position 304*a* where the tooling plate 228 is aligned with a wall 104 surface. In some embodiments, the second position 304*a* represents a range of adjustment of the head assembly 224 in the first direction 230. FIG. 4K is an image that illustrates an example of a perspective view of alignment indicators 434 when the apparatus 200 is in the second position 304*a* of FIG. 3B, according to an embodiment. As depicted in FIG. 4K, the second position 304*a* is indicated by the alignment indicators 434 based on the alignment indicator 434*a* on the adjustment block 426 being aligned with an outer alignment indicator 434*c* on the machine base plate 400. In an example embodiment, the center alignment indicator 434*b* and outer alignment indicator 434*c* are spaced apart by 12 mm.

Figure 4L:
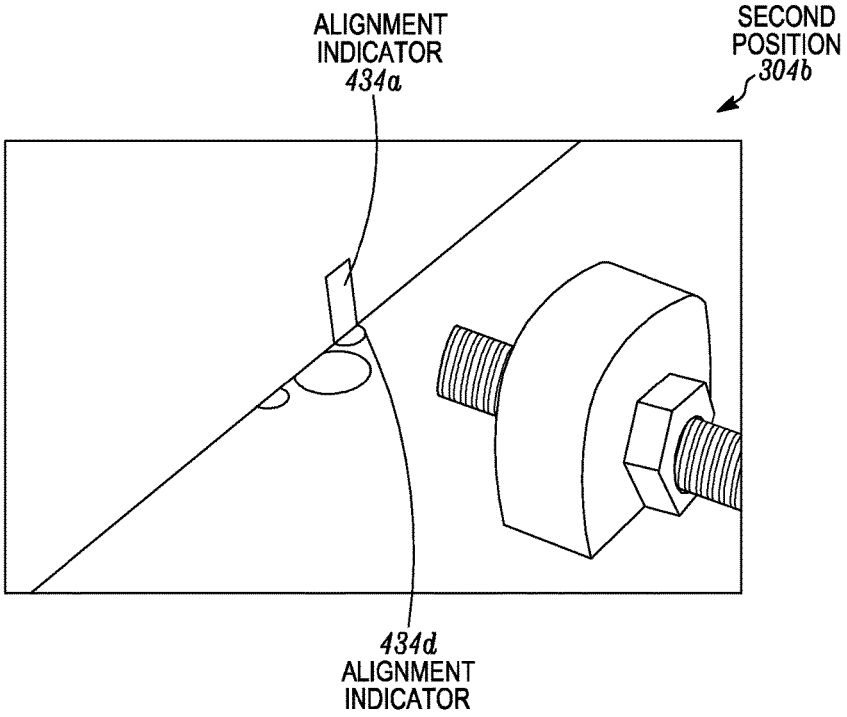
FIG. 4L is an image that illustrates an example of a perspective view of alignment indicators when the apparatus is in the second position of FIG. 3B, according to an embodiment.

As previously discussed, the apparatus 200 is configured to displace the head assembly 224 (e.g. bottom plate 226) and tooling plate 228 from the first position 302 in the second direction 232. In one embodiment, the head assembly 224 and tooling plate 228 can be adjusted from the first position 302 in the second direction 232 to a second position 304*b*, in a similar manner as the head assembly 224 and tooling plate 228 can be adjusted from the first position 302 in the first direction 230 to the second position 304*a*. In some embodiments, the second position 304*b* represents a range of adjustment of the head assembly 224 in the second direction 232. FIG. 4L is an image that illustrates an example of a perspective view of alignment indicators 434 when the apparatus 200 is in the second position 304*b*, according to an embodiment. As depicted in FIG. 4L, the second position 304*b* is indicated by the alignment indicators 434 based on the alignment indicator 434*a* on the adjustment block 426 being aligned with an outer alignment indicator 434*d* on the machine base plate 400. In one embodiment, the outer alignment indicators 434*c*, 434*d* are positioned at equal and opposite distances from the center alignment indicator 434*b* on the machine base plate 400.

Figure 5A:
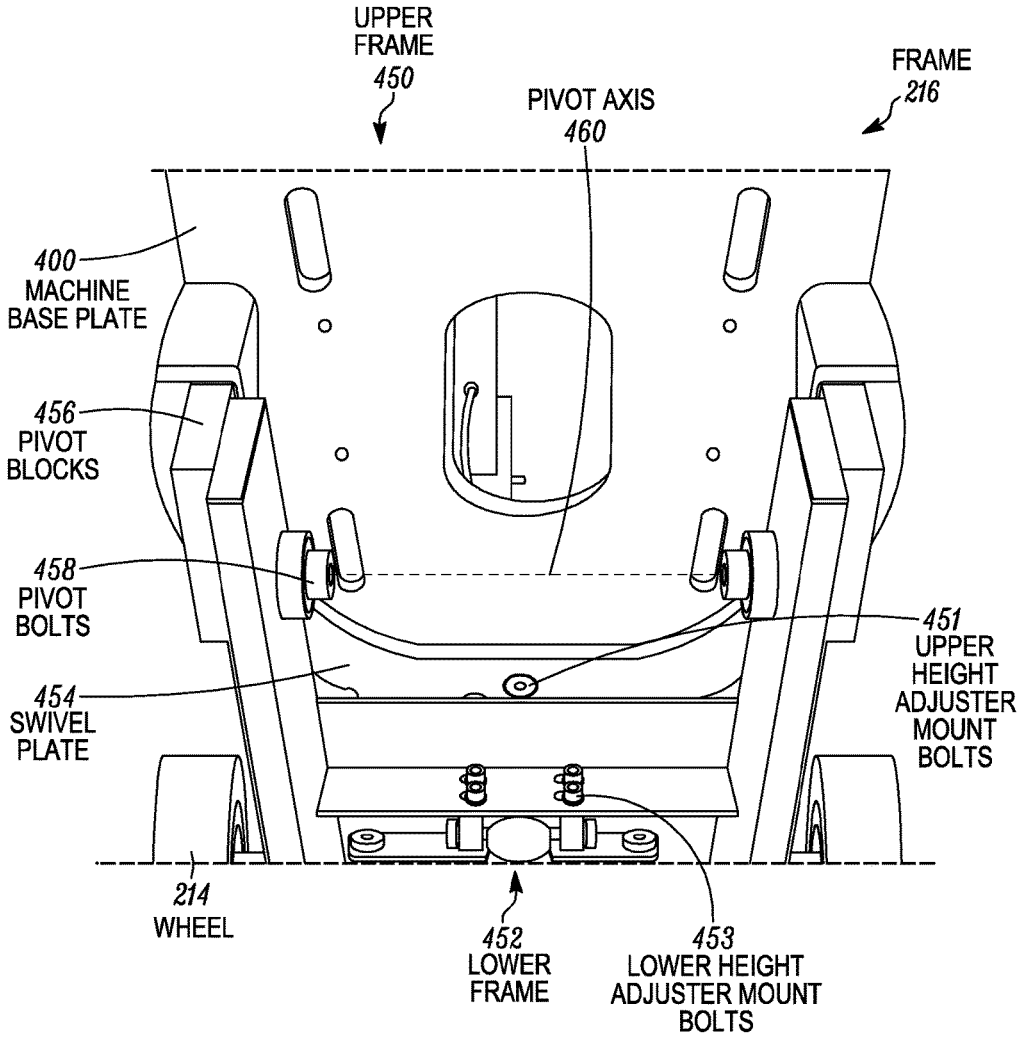
FIG. 5A is an image that illustrates an example of a bottom perspective view of the frame of the apparatus of FIG. 2A, according to an embodiment.

FIG. 5A is an image that illustrates an example of a bottom perspective view of the frame 216 of the apparatus 200 of FIG. 2A, according to an embodiment. As depicted in FIG. 5A, the frame 216 includes an upper frame 450 and a lower frame 452, where the wheels 214 are mounted to the lower frame 452 and the head assembly 224 (and machine base plate 400) is mounted to the upper frame 450. In one embodiment, the upper frame 450 and the lower frame 452 are pivotally coupled about a pivot axis 460 using a pair of pivot bolts 458. In an example embodiment, pivot blocks 456 of the upper frame 450 are pivotally coupled to the lower frame 452 with the pivot bolts 458. In an example embodiment, the pivot bolts 458 are shoulder bolts. In an embodiment, the upper frame 450 is pivoted relative to the lower frame 452 so that the tooling plate 228 mounted on the bottom plate 226 is oriented parallel to the floor surface.

Figure 5B:
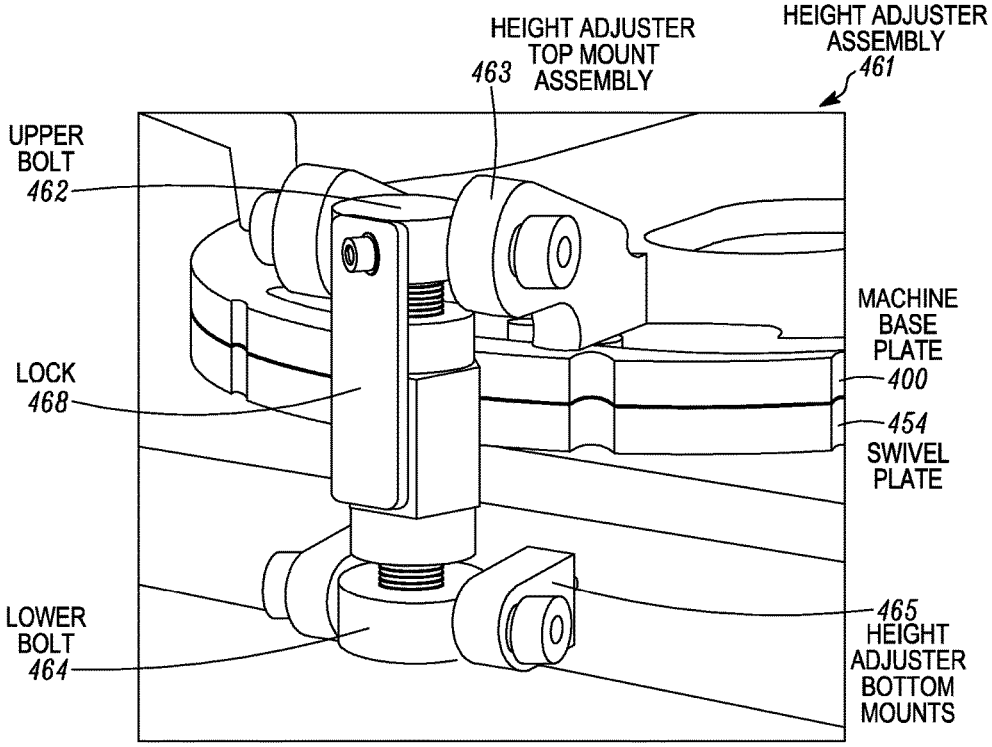
FIG. 5B is an image that illustrates an example of a perspective view of a height adjuster nut connected to the frame of FIG. 5A and in a locked position, according to an embodiment.

FIG. 5B is an image that illustrates an example of a perspective view of a height adjuster nut 466 connected to the frame 216 of FIG. 5A and in a locked position, according to an embodiment. In one embodiment, an upper bolt 462 is mounted to the upper frame 450. In an example embodiment, the upper bolt 462 is mounted to a height adjuster top mount assembly 463 (using a pair of bolts) and the height adjuster top mount assembly 463 is mounted to a swivel plate 454 of the upper frame 450 through a height adjuster swivel slot 478*a* (FIG. 5G) of the machine base plate 400. In an example embodiment, the height adjuster top mount assembly 463 is mounted to the swivel plate 454 by securing a plurality of upper height adjuster mount bolts 451 (FIG. 5A) through a plurality of spacers 467 (FIG. 5C) and into the swivel plate 454. In other embodiments, no swivel plate 454 is provided and the height adjuster top mount assembly 463 is secured to the machine base plate 400. In this embodiment, the machine base plate 400 is not rotated relative to the lower frame 452.

In another embodiment, a lower bolt 464 is mounted to the lower frame 452. In an example embodiment, the lower bolt 464 is mounted to height adjuster bottom mounts 465 (using a pair of bolts) and the height adjuster bottom mounts 465 are mounted to the lower frame 452. In an example embodiment, the height adjuster bottom mounts 465 are mounted to the lower frame 452 using a plurality of lower height adjuster mount bolts 453 (FIG. 5A).

In some embodiments, the upper bolt 462 has external threads oriented in a first direction and the lower bolt 464 has external threads oriented in a second direction opposite to the first direction. In these embodiments, the height adjuster nut 466 includes an opening at opposite ends, where the opening includes internal threads. A first end of the height adjuster nut 466 threadably engages the external threads of the upper bolt 462 and a second end of the height adjuster nut 466 threadably engages the external threads of the lower bolt 464. In this embodiment, upon rotation of the height adjuster nut 466 (e.g. using an adjustment tool), the upper bolt 462 and the lower bolt 464 are displaced in opposite directions within the opening of the height adjuster nut 466.

In one example embodiment, when the height adjuster nut 466 is rotated in a first direction, the upper bolt 462 and the lower bolt 464 move away from each other, i.e. the external threads of both bolt 462, 464 within the opening of the height adjuster nut 466 move away from each other and consequently the bolt 462, 464 separate from each other. In another example embodiment, when the height adjuster nut 466 is rotated in a second direction opposite to the first direction, the upper bolt 462 and the lower bolt 464 move toward each other, i.e. the external threads of both bolt 462, 464 within the opening of the height adjuster nut 466 move further inward into the opening of the height adjuster nut 466.

Figure 5C:
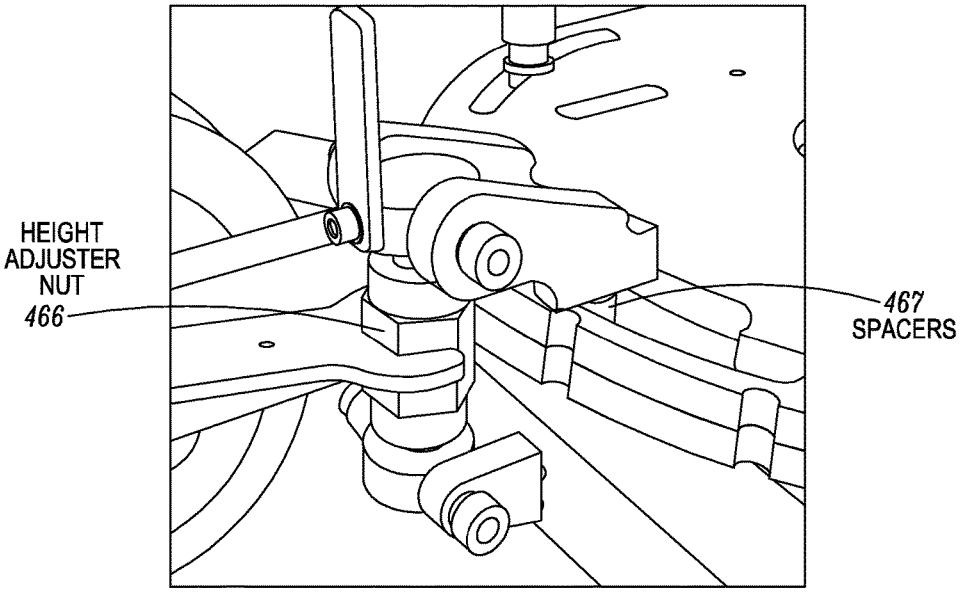
FIG. 5C is an image that illustrates an example of a perspective view of the height adjuster nut of FIG. 5B in an unlocked position, according to an embodiment.

In an example embodiment, the height adjuster nut 466 in FIG. 5B is in the locked position, so that the height adjuster nut 466 cannot be adjusted. This advantageously prevents the height adjuster nut 466 from being accidentally adjusted through operating conditions (e.g. vibrations). In one embodiment, a rotatable lock 468 is provided and is rotatably coupled to the upper bolt 462. In other embodiments, the rotatable lock 468 is rotatably coupled to the lower bolt 464. When the lock 468 is rotated to the position shown in FIG. 5B, the height adjuster nut 466 cannot be rotated. FIG. 5C is an image that illustrates an example of a perspective view of the height adjuster nut 466 of FIG. 5B in an unlocked position, according to an embodiment. In an example embodiment, the unlocked position of FIG. 5C is obtained by simply rotating the lock 468 from the locked position of FIG. 5B to the unlocked position of FIG. 5C. In the unlocked position of FIG. 5C, the height adjuster nut 466 can be rotated using various means (e.g. tool).

Figure 5D:
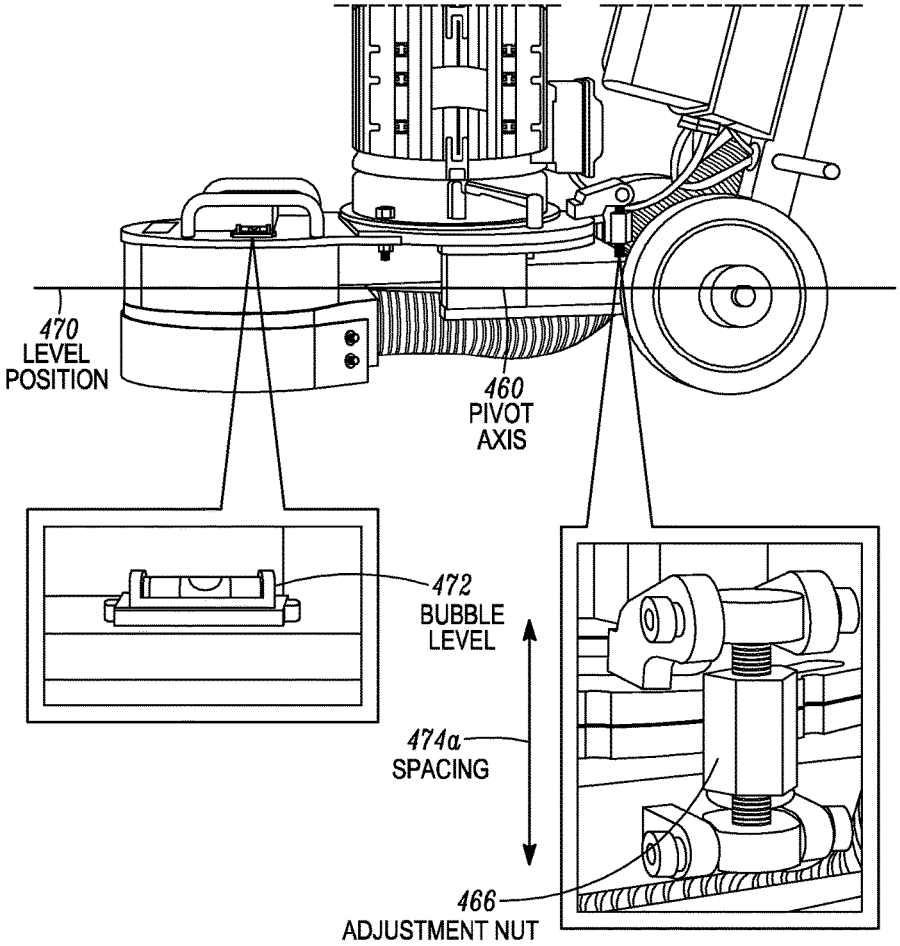
FIG. 5D is an image that illustrates an example of a side view of the apparatus of FIG. 2A in a level position, according to an embodiment.

FIG. 5D is an image that illustrates an example of a side view of the apparatus 200 of FIG. 2A in a level position 470, according to an embodiment. In one embodiment, the level position 470 is defined as a position where the machine base plate 400 is level with the floor surface. In an example embodiment, a bubble level 472 is provided on the frame 216 and indicates that the machine base plate 400 is level with the floor surface in the level position 470. As further depicted in FIG. 5D, in the level position 470, the adjustment nut 466 is arranged so that a particular spacing 474*a* is provided between the upper bolt 462 and lower bolt 464.

Figure 5E:
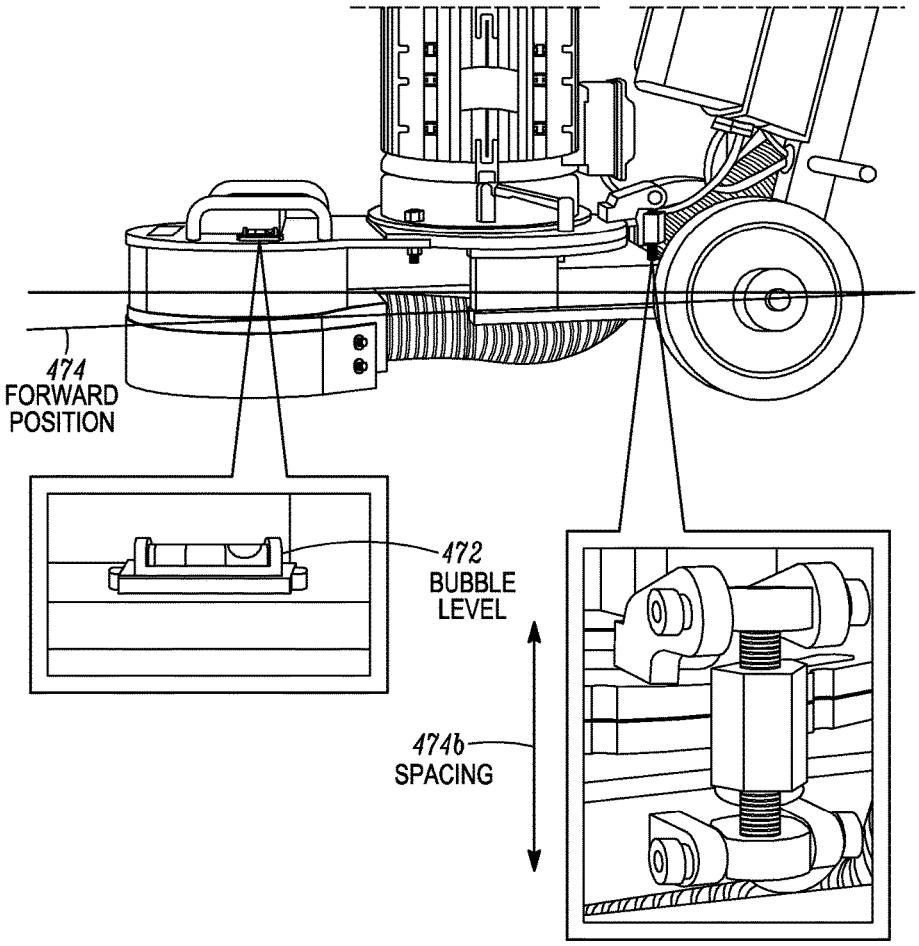
FIG. 5E is an image that illustrates an example of a side view of the apparatus of FIG. 2A in a forward position, according to an embodiment.
Figure 5F:
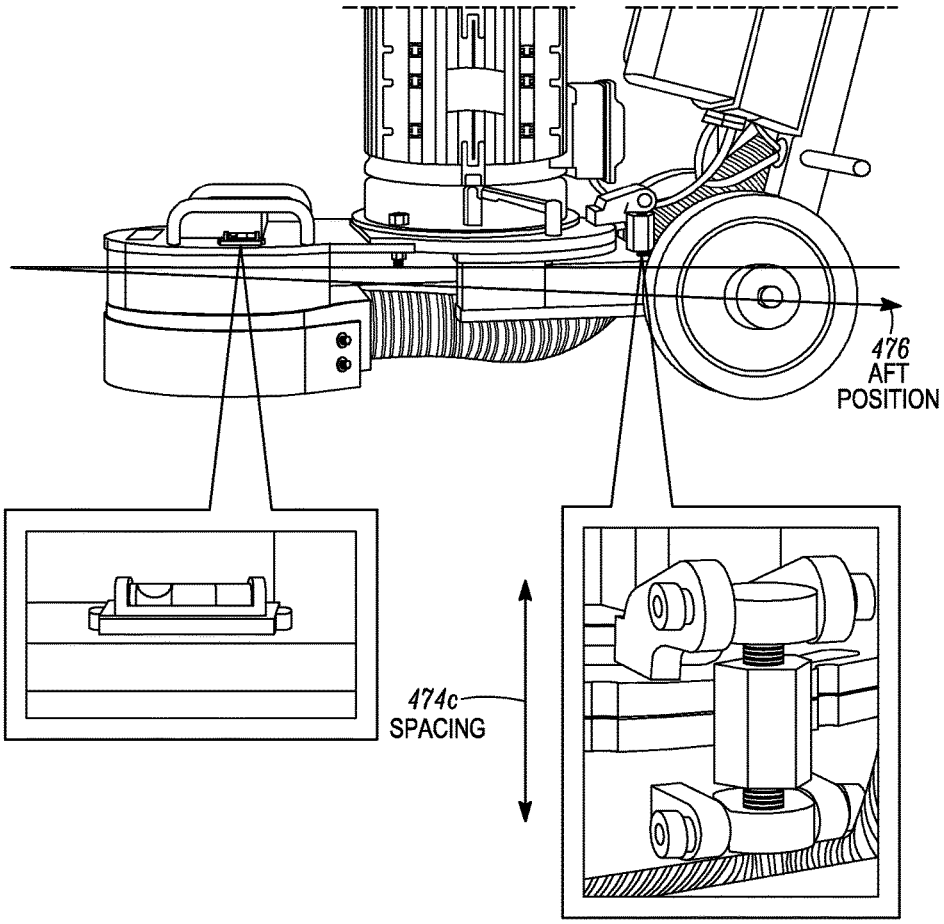
FIG. 5F is an image that illustrates an example of a side view of the apparatus of FIG. 2A in an AFT position, according to an embodiment.

Based on a thickness of a tooling plate 228 mounted on the bottom plate 226, the height adjustment nut 466 can be adjusted, to maintain the machine base plate 400 at a level position, so that the tooling plate 228 is maintained at an orientation that is parallel to the floor surface. FIGS. 5E-5F depict images that illustrate a side view of the apparatus 200 in different positions. In one example (e.g. FIG. 5E), the height adjuster nut 466 is adjusted so that a spacing 474*b* is between the upper bolt 462 and lower bolt 464, in order to maintain the machine base plate 400 at the level position. In another example (e.g. FIG. 5F), the height adjuster nut 466 is adjusted so that a spacing 474*c* is between the upper bolt 462 and lower bolt 464, in order to maintain the machine base plate 400 at the level position. As depicted in FIGS. 5E-5F, the spacings 474*b*, 474*c* of the height adjuster nut 466 are different since depending on the thickness of the tooling plate 228, the height adjuster nut 466 is adjusted to a different spacing 474, in order to maintain the machine base plate 400 at the level position, i.e. level with the floor surface. In an example embodiment, the height adjuster bolt 466 can be used to tilt the machine base plate 400 by about 5 degrees upward and about 8 degrees downward (relative to the lower frame 452). Although FIGS. 5A-5F depict embodiments employing a height adjuster nut 466 to pivot the upper frame 450 relative to the lower frame 452, the embodiments of the invention are not limited to this arrangement and include any arrangement appreciated by one of ordinary skill in the art that could be used to pivot the upper frame 450 relative to the lower frame 452. In an example embodiment, a simple motor could be coupled to the upper frame 450 and the lower frame 452 and used to pivot the upper frame 450 relative to the lower frame 452. In an example embodiment, such a motor could be any one of a hydraulic motor (e.g. hydraulic pistons) and a electric motor (e.g. servo motor).

As depicted in FIG. 5B, the upper frame 450 includes the machine base plate 400 and the swivel plate 454. In some embodiments, the machine base plate 400 can be rotated or swiveled with respect to the swivel plate 454. An advantage of this feature is that the head assembly 224 (and consequently the bottom plate 226 and tooling plate 228) can be correspondingly rotated with respect to the swivel plate 454 and also with respect to the lower frame 452. In conventional concrete grinders (FIG. 1A), the handle of the concrete grinder is typically wider than the frame 112 of the grinder and thus prevents the concrete grinder from achieving zero-tolerance edging, i.e. being pushed along the intersection of the wall 104 surface and floor 106 surface (FIG. 1B). To overcome this noted drawback, the inventors of the present invention designed the apparatus 200 with the features discussed herein. In some embodiments, the noted drawback was overcome with the introduced swivel or rotation between the machine base plate 400 and the swivel plate 454 (and lower frame 452).

Figure 5G:
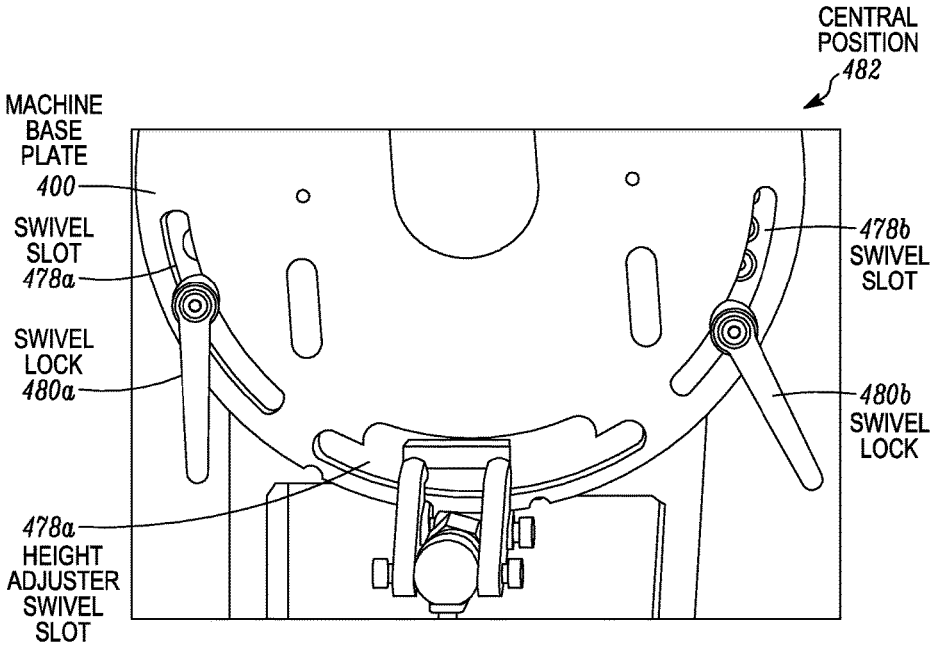
FIG. 5G is an image that illustrates an example of a top view of the upper frame in a central position relative to the lower frame of FIG. 5A, according to an embodiment.

FIG. 5G is an image that illustrates an example of a top view of the upper frame 450 in a central position 482 relative to the lower frame 452 of FIG. 5A, according to an embodiment. In one embodiment, the central position 482 is a position defined by an alignment between the machine base plate 400 and the lower frame 452 of the apparatus 200. In the central position 482, the head assembly 224 and bottom plate 226 are aligned with the lower frame 452 of the apparatus 200. In one embodiment, the machine base plate 400 includes a plurality of slots including a height adjuster swivel slot 478*a* in which the height adjuster top mount assembly 463 is mounted to the swivel plate 454 using spacers 467 (FIGS. 5B-5C). Additionally, in one embodiment, the machine base plate 400 includes swivel slots 478*a*, 478*b* and swivel locks 480*a*, 480*b* respectively positioned in the swivel slots 478*a*, 478*b*. To rotate the machine base plate 400 relative to the swivel plate 454 and lower frame 452, the swivel locks 480*a*, 480*b* are first unlocked. In an example embodiment, the swivel locks 480*a*, 480*b* are unlocked by rotating the swivel locks 480*a*, 480*b* in a first direction (e.g. counterclockwise direction). Once the swivel locks 480*a*, 480*b* are unlocked, the machine base plate 400 is rotated relative to the swivel plate 454 until a desired pivot position 484 is obtained.

Figure 5H:
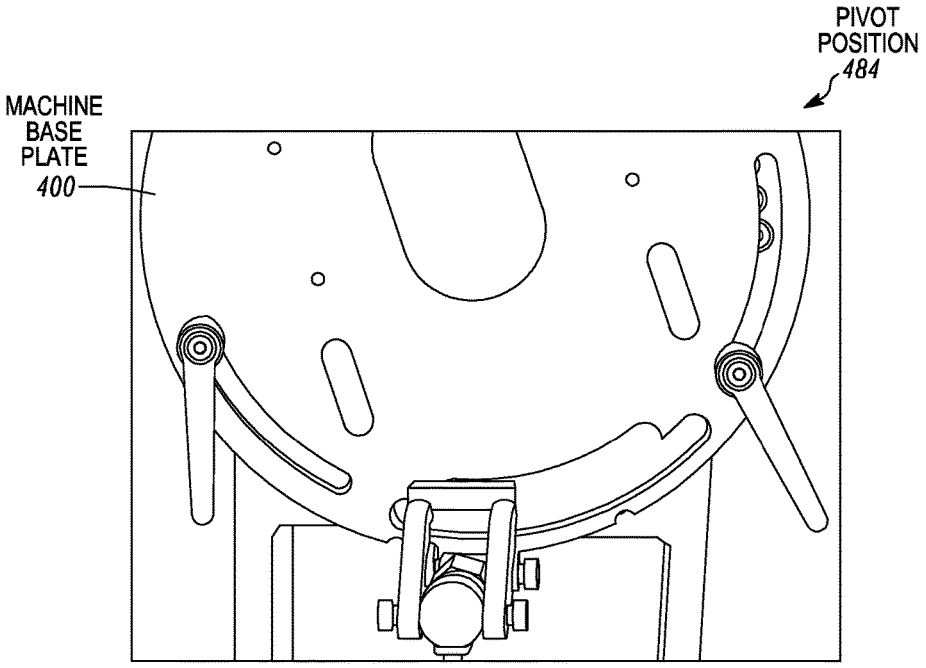
FIG. 5H is an image that illustrates an example of a top view of the upper frame in a pivot position relative to the lower frame of FIG. 5A, according to an embodiment.

FIG. 5H is an image that illustrates an example of a top view of the upper frame 450 in a pivot position 484 relative to the lower frame 452 of FIG. 5A, according to an embodiment. In the embodiment of FIG. 5H, the pivot position 484 is a maximum pivot position between the machine base plate 400 and the swivel plate 454. In an example embodiment, the maximum pivot position is obtained when the swivel locks 480*a*, 480*b* have shifted to a maximum position within the swivel slots 478*a*, 478*b*. In an example embodiment, an angle between the central position 482 and the pivot position 484 is in a range of about ±20 degrees. Although FIG. 5H depicts a maximum pivot position, the machine base plate 400 can be rotated to and locked at any pivot position between the central position 482 and the pivot position 484, depending on the particular needs of a project. After rotating the machine base plate 400 to the pivot position 484, the swivel locks 480*a*, 480*b* are locked (e.g. turning in clockwise direction until tight) to fix the machine base plate 400 in the pivot position 484. In an example embodiment, in the pivot position 484, the machine base plate 400 and bottom plate 226 are oriented at an angle (e.g. 20 degrees) that is offset from the lower frame 452.

Figure 5I:
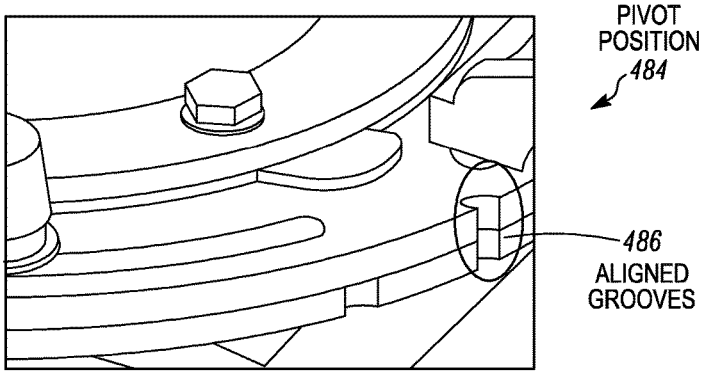
FIG. 5I is an image that illustrates an example of a perspective view of aligned grooves in the base plate and swivel plate in the pivot position of FIG. 5H, according to an embodiment.
Figure 5J:
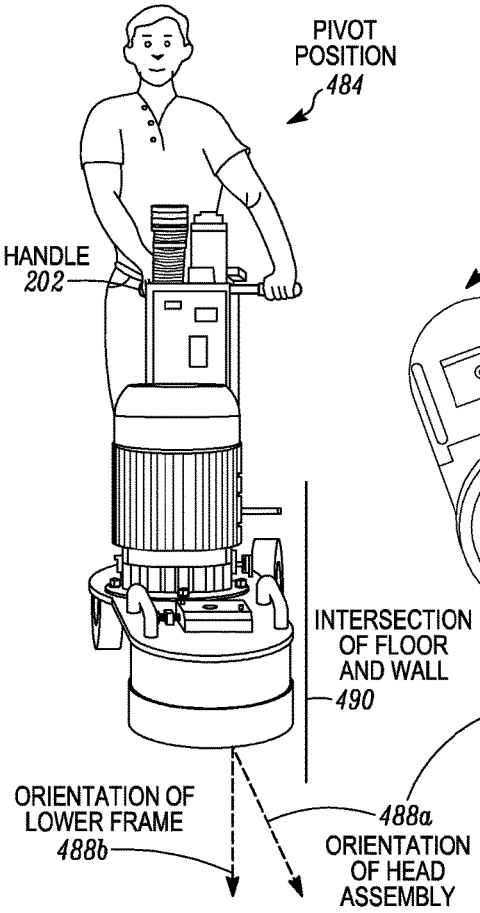
FIG. 5J is an image that illustrates an example of a front view of the apparatus of FIG. 2A with the upper frame in the pivot position, according to an embodiment.
Figure 5K:
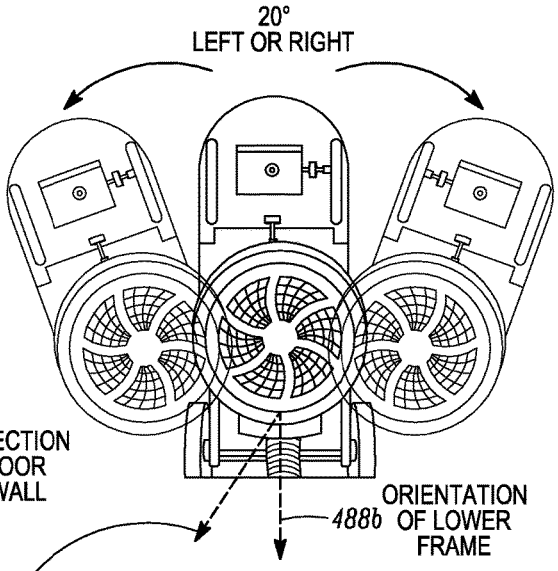
FIG. 5K is an image that illustrates an example of a top view of the apparatus of FIG. 2A with the upper frame in the pivot position, according to an embodiment.

FIG. 5J is an image that illustrates an example of a front view of the apparatus 200 of FIG. 2A with the upper frame 450 in the pivot position 484, according to an embodiment. In one embodiment, when the upper frame 450 is positioned in the pivot position 484, an orientation 488*b* of the lower frame 452 is about parallel with an intersection 490 of the wall and floor and thus the path of travel (e.g. path of wheels 214) of the apparatus 200 is about parallel with the intersection 490. Additionally, as depicted in FIG. 5J, an orientation 488*a* of the machine base plate 400 (and head assembly 224) is oriented inward toward the intersection 490 and inward toward the wall surface. By orienting the head assembly 224 toward the intersection 490 of the floor and wall surfaces, positioning the head assembly 224 over the intersection 490 and orienting the path of travel along the intersection 490, zero-tolerance edging of the floor surface is achieved, while the user pushes the apparatus 200 along a path that is parallel to the intersection 490 and parallel to the wall 104 surface. FIG. 5K is an image that illustrates an example of a top view of the apparatus 200 of FIG. 2A with the upper frame 450 in the pivot position 484, according to an embodiment. In one embodiment, the top view of FIG. 5K depicts the range of angles over which the machine base plate 400 can be rotated. In some embodiments of the apparatus 200, no swivel plate 454 is provided and thus the machine base plate 400 is not rotatable with respect to the swivel plate 454. In these embodiments, the height adjuster top mount assembly 463 is mounted to the machine base plate 400.

FIG. 5I is an image that illustrates an example of a perspective view of aligned grooves 486 in the base plate 400 and swivel plate 454 in the pivot position 484 of FIG. 5H, according to an embodiment. In one embodiment, the base plate 400 and swivel plate 454 each include one or more spaced grooves 486. In the central position 482, each groove 486 of the base plate 400 is aligned with a groove 486 of the swivel plate 454. In the pivot position 484, one or more grooves 486 of the base plate 400 are aligned with a groove 486 of the swivel plate 454. In an example embodiment, where the base plate 400 and swivel plate 454 are each provided with four spaced apart grooves 486, all four grooves 486 are aligned in the central position 482 and two of the four grooves 486 are aligned in the pivot position 484.

Figure 6A:
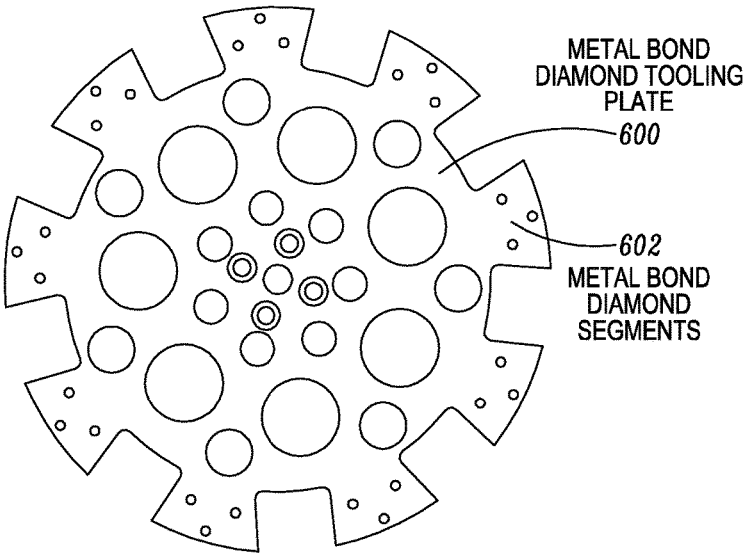
FIG. 6A is an image that illustrates an example of a front view of a metal bond diamond tooling plate, according to an embodiment.

FIG. 6A is an image that illustrates an example of a front view of a metal bond diamond tooling plate 600, according to an embodiment. In one embodiment, the metal bond diamond tooling plate 600 includes one or more metal bond diamond segments 602. In some embodiments, the metal bond diamond segments 602 are similar to the tooling 229 discussed previously above. In an example embodiment, the tooling plate 600 has different diameters (e.g. 12 inch, 20 inch) and includes a plurality of circumferentially located trapezoidal tooling segments 602 for accepting metal bond tooling.

Figure 6B:
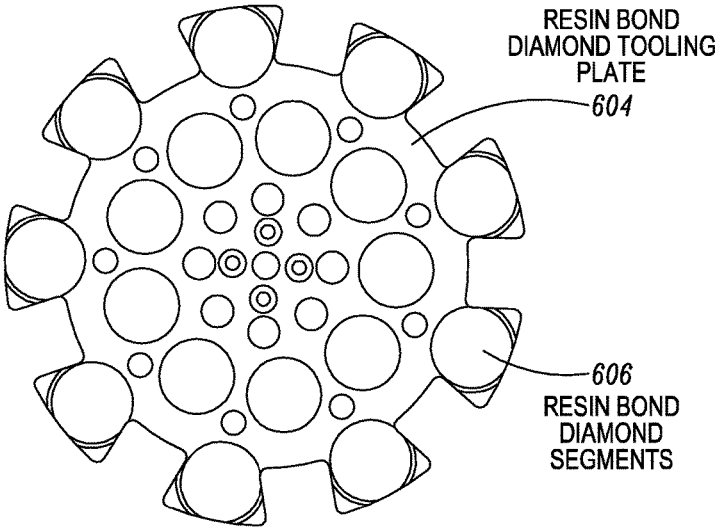
FIG. 6B is an image that illustrates an example of a front view of a resin bond diamond tooling plate, according to an embodiment.

FIG. 6B is an image that illustrates an example of a front view of a resin bond diamond tooling plate 604, according to an embodiment. In some embodiments, the resin bond diamond tooling plate 604 includes one or more resin bond diamond segments 606.

In an example embodiment, each tooling plate 600, 602 (e.g. 12 inch or 20 inch) comprises a plurality of circumferentially located trapezoidal tooling segments for accepting metal bond tooling or a plurality of circumferentially located round cavities for accepting resin bond tooling that each carry a grinding or polishing surface. Concrete grinding refers to a method that uses a machine equipped with metal bond diamonds for grinding the concrete floor, beginning with a lower grit diamond and working toward higher grit diamond to smooth and tighten the concrete floor. Concrete polishing continues from the last highest grit metal bond diamond that was used and involves tooling made from resin bond diamonds. The difference between metal and resin bond tooling is that the diamonds in the metal bond are held together in a matrix composed of an assortment of metal elements such as copper, tin, iron, etc and diamonds in the resin bond are held together in a matrix composed of resin material. Concrete polishing is a process by which the floor is honed from a low grit to as high a grit as desired to produce an extremely smooth floor that if so desired can shine like a mirror as higher resin diamond grits are used.

Figure 6C:
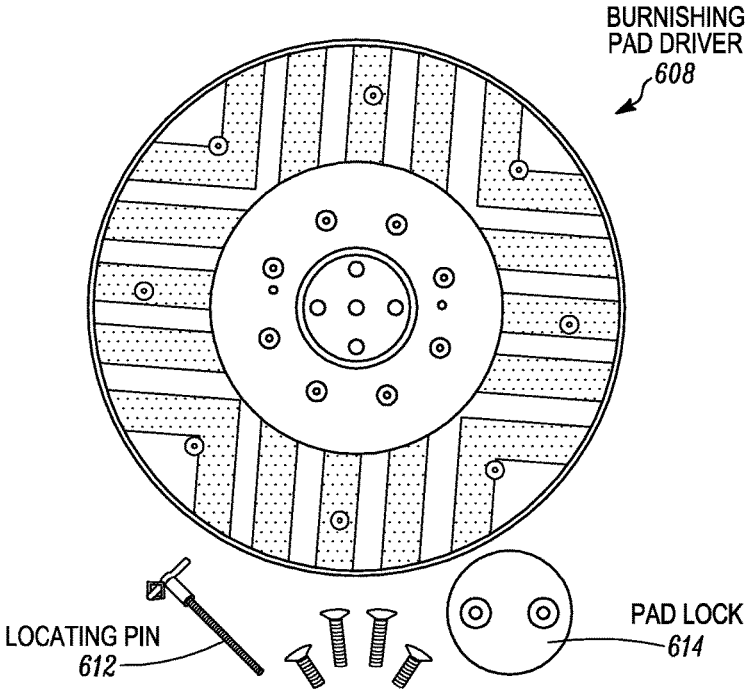
FIG. 6C is an image that illustrates an example of a front view of a burnishing pad driver, according to an embodiment.
Figure 6D:
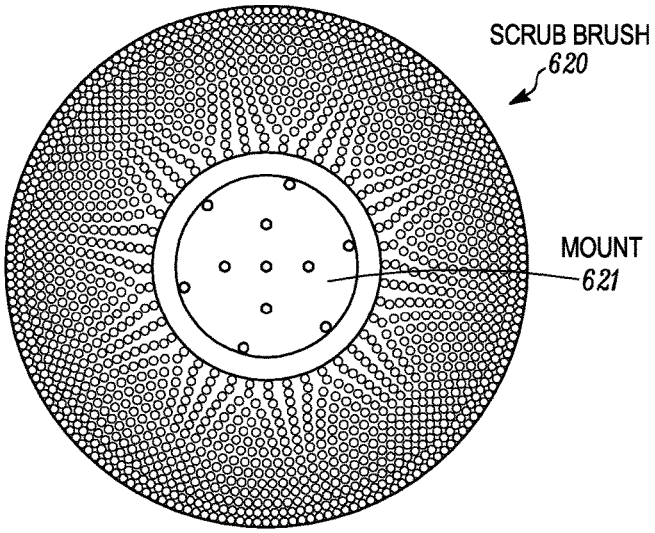
FIG. 6D is an image that illustrates an example of a front view of a scrub brush, according to an embodiment.
Figure 6E:
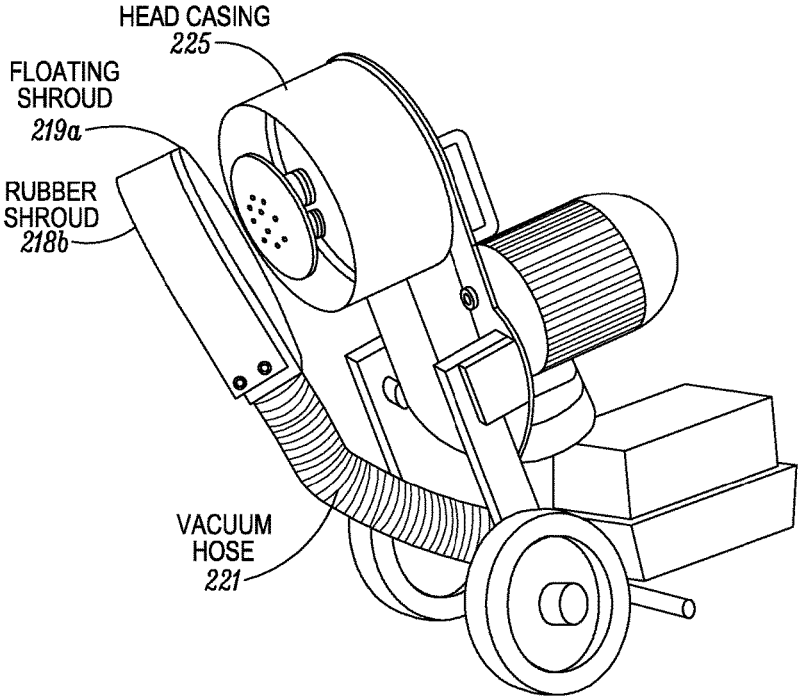
FIG. 6E is an image that illustrates an example of a perspective view of installing a shroud with a first diameter on the apparatus of FIG. 2A, according to an embodiment.
Figure 6F:
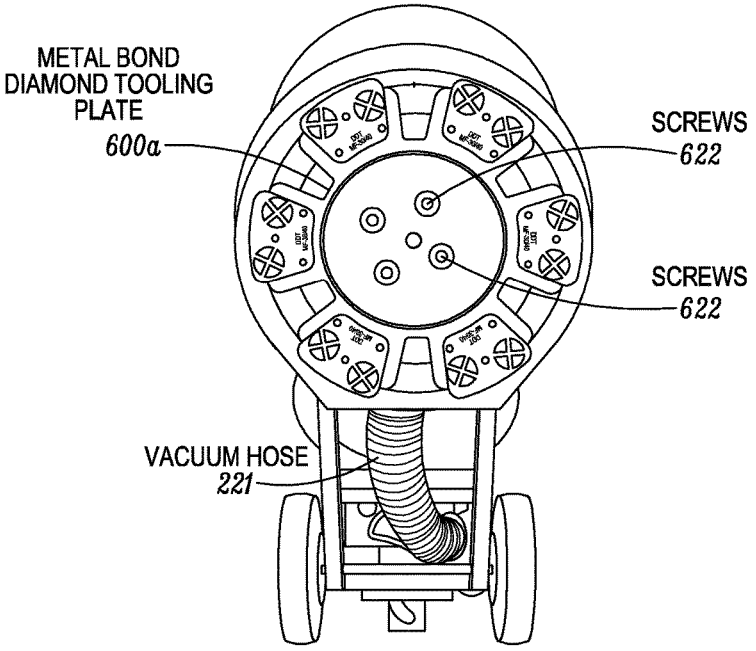
FIG. 6F is an image that illustrates an example of a front view of a diamond tooling plate of a first diameter mounted to the bottom plate of the apparatus of FIG. 2A, according to an embodiment.
Figure 6G:
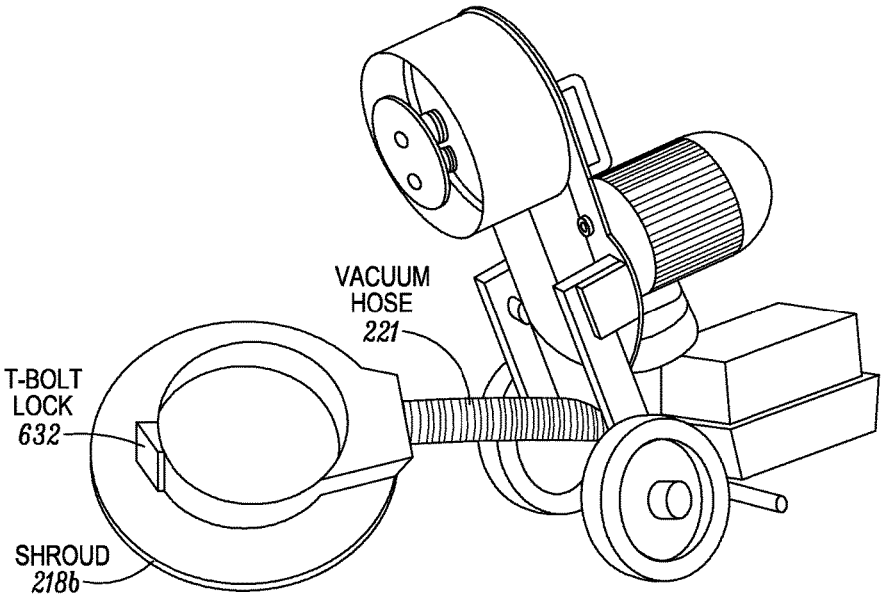
FIG. 6G is an image that illustrates an example of a perspective view of installing a shroud with a second diameter on the apparatus of FIG. 2A, according to an embodiment.
Figure 6H:
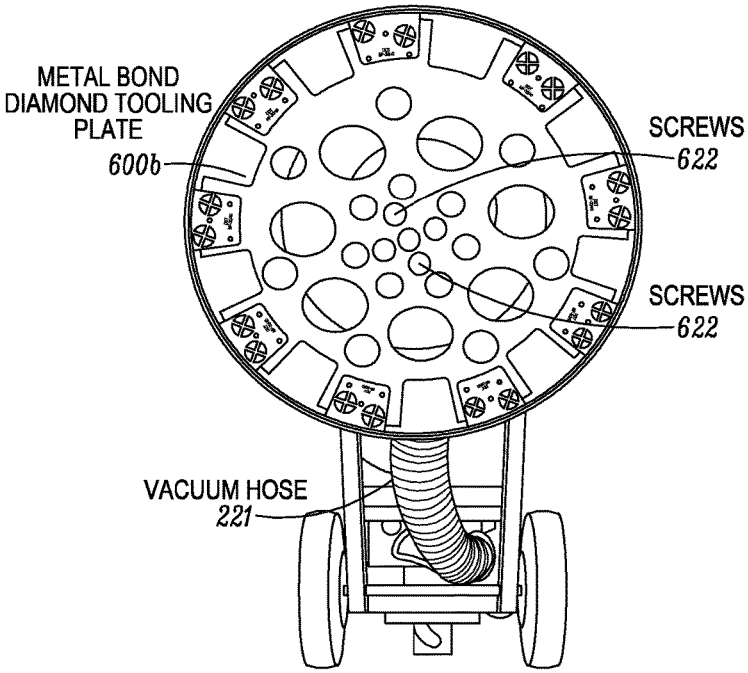
FIG. 6H is an image that illustrates an example of a front view of a diamond tooling plate of a second diameter mounted to the bottom plate of the apparatus of FIG. 2A, according to an embodiment.
Figure 6I:
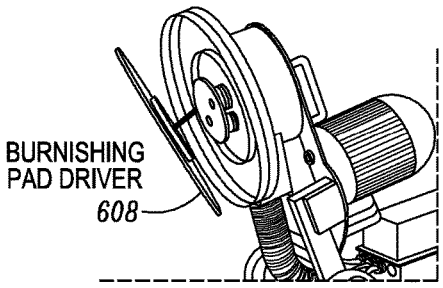
FIG. 6I is an image that illustrates an example of a side view of securing the burnishing pad driver to the bottom plate of the apparatus of FIG. 2A, according to an embodiment.
Figure 6J:
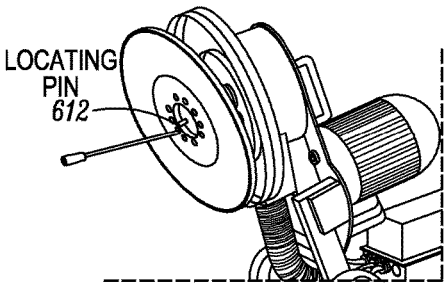
FIG. 6J is an image that illustrates an example of a side view of securing the burnishing pad driver to the bottom plate of the apparatus of FIG. 2A, according to an embodiment.
Figure 6K:
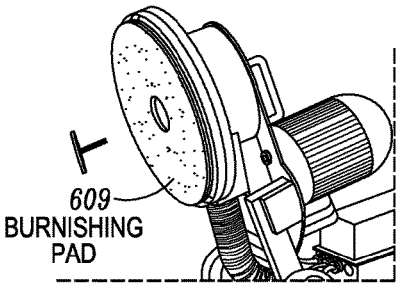
FIG. 6K is an image that illustrates an example of a side view of securing a burnishing pad to the bottom plate of the apparatus of FIG. 2A, according to an embodiment.
Figure 6L:
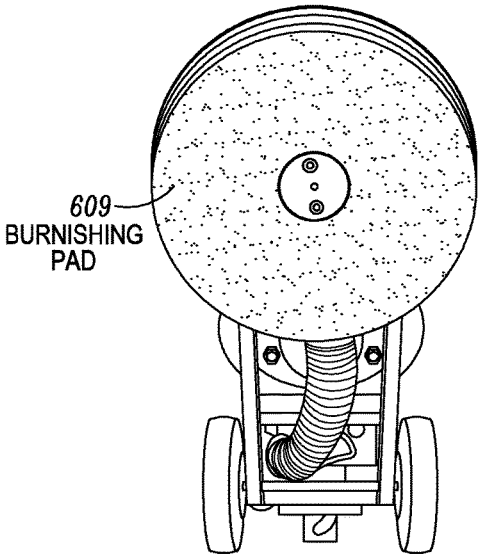
FIG. 6L is an image that illustrates an example of a side view of securing a burnishing pad to the bottom plate of the apparatus of FIG. 2A, according to an embodiment.
Figure 6M:
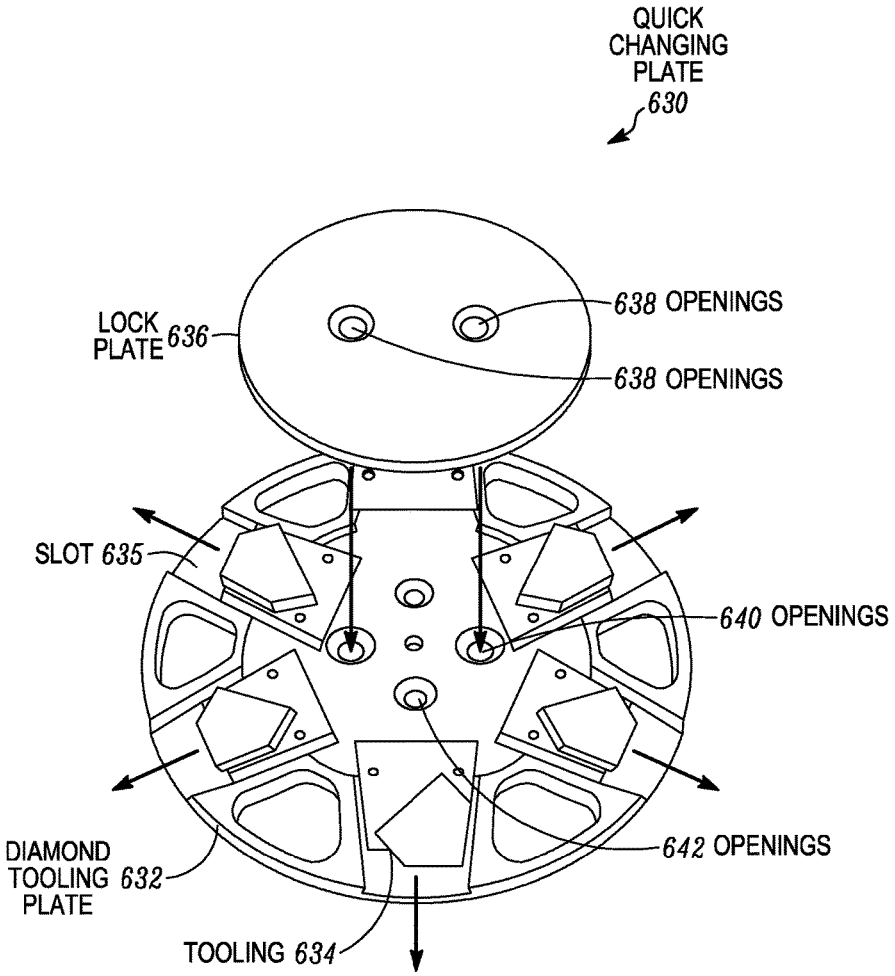
FIG. 6M is an image that illustrates an example of an exploded view of a quick change tooling plate, according to an embodiment.

FIG. 6M is an image that illustrates an example of an exploded view of a quick change tooling plate 630, according to an embodiment. In some embodiments, the quick change tooling plate 630 is similar to the tooling plate 228, but does not require screws to mount the tooling 634 to the diamond tooling plate 632. Instead, the tooling 634 is slid into respective slots 635. A lock plate 636 is provided and positioned within an interior of the quick change plate 630 such that an outer surface of the lock plate 636 abuts an inner surface of the tooling 634, thereby maintaining the tooling 634 in each slot 635. In an embodiment, the quick change plate 630 is particularly advantageous for use in the apparatus 200, where zero-tolerance edging is possible along an edge of a floor surface that intersects with a wall surface. The inventors of the present invention recognized that during zero-tolerance edging, contact between the wall surface and an outer surface of the tooling 634 (that extend beyond the shroud) will likely occur. In order to ensure that the tooling 634 are fixed in the slots 635 and are not dislodged during such contact, the lock plate 636 was introduced, which abuts the inner surface of the tooling 634 and thus keeps the tooling 634 within the respective slot 635. To mount the quick change plate 630 to the bottom plate 226, a pair of screws are passed through a first pair of openings 642 in the diamond tooling plate 632 and into a pair of openings in the bottom plate 226. This secures the diamond tooling plate 632 to the bottom plate 226. The lock plate 636 is then positioned within the interior of the diamond tooling plate 632. A pair of screws are passed through aligned openings 638 of the lock plate 636 and openings 640 in the diamond tooling plate 632 and into a pair of openings in the bottom plate 226.

FIG. 6C is an image that illustrates an example of a front view of a burnishing pad driver 608, according to an embodiment. Additionally, other equipment is depicted that is used to mount the burnishing pad driver 608 onto the bottom plate 226 including a locating pin 612 and a pad lock 614. The burnishing process utilizes burnishing pads that for the most part help remove wax or other similar chemicals from a floor using a stripping pad or similar pad and in turn reapply the wax or other chemicals using a variety of burnishing pads, by melting the material into the floor using a burnishing pad that rotates at high speed thereby creating heat and melting and driving the material into the tiny pores of the concrete floor. Burnishing pads are also available with various diamond grits impregnated into the pad which at times can remove some of the resin bond diamond polishing process or bring back to life a polished concrete floor that has lost its shine.

FIG. 6D is an image that illustrates an example of a front view of a scrub brush 620, according to an embodiment. In some embodiments, the scrub brush 620 includes any type of scrub brush appreciated by one of ordinary skill in the art, including scrub brushes manufactured by Malish® US of Mentor, Ohio. However, the scrub brush 620 need not be from any particular manufacturer. Additionally, the scrub brush 620 includes a mount 621 with a plurality of openings that correspond to the openings in the bottom plate 226. In some embodiments, scrub brushes provided by manufacturers are retrofitted with the mount 621 that is customized to align with the openings of the bottom plate 226 of the apparatus 200. In an example embodiment, any of the tooling plates 600, 602, burnishing pad driver 608 or scrub brush 620 can be mounted on the bottom plate 226 and thus the apparatus 200 can be used as a versatile all-in-one grinder, polisher, burnisher and zero-tolerance edger.

In order to install a burnishing pad 609 onto the bottom plate 226 and convert the apparatus 200 into a burnisher, the following steps are performed. In one embodiment, if one of the tooling plates 600, 602 is mounted on the bottom plate 226, the screws that mount the tooling plate 600, 602 to the bottom plate 226 are initially unscrewed so that the tooling plate 600, 602 is removed from the bottom plate 226. FIG. 6I is an image that illustrates an example of a side view of securing the burnishing pad driver 608 to the bottom plate 226 of the apparatus 200 of FIG. 2A, according to an embodiment. FIG. 6J is an image that illustrates an example of a side view of securing the burnishing pad driver 608 to the bottom plate 226 of the apparatus 200 of FIG. 2A, according to an embodiment. As depicted in FIGS. 6I-6J, a first step in securing the burnishing pad driver 608 to the bottom plate 226 is securing the locating pin 612 through a central opening in the burnishing pad driver 608 and into an opening in the bottom plate 226. This advantageously holds the burnishing pad driver 608 (hands-free) on the bottom plate 226 as the user secures the burnishing pad driver 608 to the bottom plate 226 with additional screws. In an example embodiment, two screws (e.g. M12×1.75×25 screws) are secured through openings in the burnishing pad driver 608 and into holes in the bottom plate 226 using a tool (e.g. 8 mm Allen wrench). This secures the burnishing pad driver 608 to the bottom plate 226.

FIG. 6K is an image that illustrates an example of a side view of securing a burnishing pad 609 to the bottom plate 226 of the apparatus 200 of FIG. 2A, according to an embodiment. In this step, the burnishing pad 609 is positioned over the burnishing pad driver 608 and two screws (e.g. M12×1.75×50 screws) are secured through openings in the openings in the pad lock 614 and into the bottom plate 226 using a tool (e.g. 8 mm Allen wrench). This secures the burnishing pad 609 to the bottom plate 226 and thus converts the apparatus 200 into a burnisher. FIG. 6L is an image that illustrates an example of a side view of securing a burnishing pad 609 to the bottom plate 226 of the apparatus 200 of FIG. 2A, according to an embodiment.

In one embodiment, a diamond tooling plate 600*a* of a first diameter (e.g. 12") can be replaced with a diamond tooling plate 600*b* of a second larger diameter (e.g. 20"), so to convert the apparatus 200 to a larger diameter grinder. Additionally, a diamond tooling plate 600*b* of a second diameter can be replaced with a diamond tooling plate 600*a* of a first smaller diameter, so to convert the apparatus 200 to a smaller diameter grinder.

FIG. 6E is an image that illustrates an example of a perspective view of installing a rubber shroud 218*a* and floating shroud 219*a* with a first diameter on the apparatus 200 of FIG. 2A, according to an embodiment. As previously discussed, the rubber shroud 218*a* is secured around a perimeter of the floating shroud 219*a* by securing each side of the rubber shroud 218*a* on shroud pins on each side of the floating shroud 219*a*. Additionally, a vacuum hose 221 outlet is secured to a dust port inlet on the floating shroud 219*a*. The floating shroud 219*a* is then placed over the head casing 225. FIG. 6F is an image that illustrates an example of a front view of a diamond tooling plate 600*a* of a first diameter mounted to the bottom plate 226 of the apparatus 200 of FIG. 2A, according to an embodiment. In an example embodiment, the diamond tooling plate 600*a* is mounted to the bottom plate 226 by screwing four screws (e.g. M12×.1.75×25) through the diamond tooling plate 600*a* and into four holes in the bottom plate 226.

To replace the diamond tooling plate 600*a* of the first diameter with the diamond tooling plate 600*b* of a larger second diameter, the diamond tooling plate 600*a* is first dismounted from the bottom plate 226, by unscrewing the four screws. The floating shroud 219*a* and rubber shroud 218*a* are then removed from the head casing 225 and the vacuum hose inlet 221 is detached from the dust port inlet of the floating shroud 219*a*. FIG. 6G is an image that illustrates an example of a perspective view of installing a shroud 218*b* with a second diameter on the apparatus 200 of FIG. 2A, according to an embodiment. To install the shroud on the head casing 225, the vacuum hose 221 is first attached to a dust port outlet on the shroud 218*b*. The shroud 218*b* is then positioned over the head casing 225. The shroud 218*b* is then secured around the head casing 225 using a T-bolt lock 632. FIG. 6H is an image that illustrates an example of a front view of a diamond tooling plate 600*b* of a second diameter mounted to the bottom plate 226 of the apparatus 200 of FIG. 2A, according to an embodiment. In an example embodiment, the diamond tooling plate 600*b* is mounted to the bottom plate 226 by screwing four screws (e.g. M12×.1.75×25) through the diamond tooling plate 600*b* and into four holes in the bottom plate 226.

Figure 7:
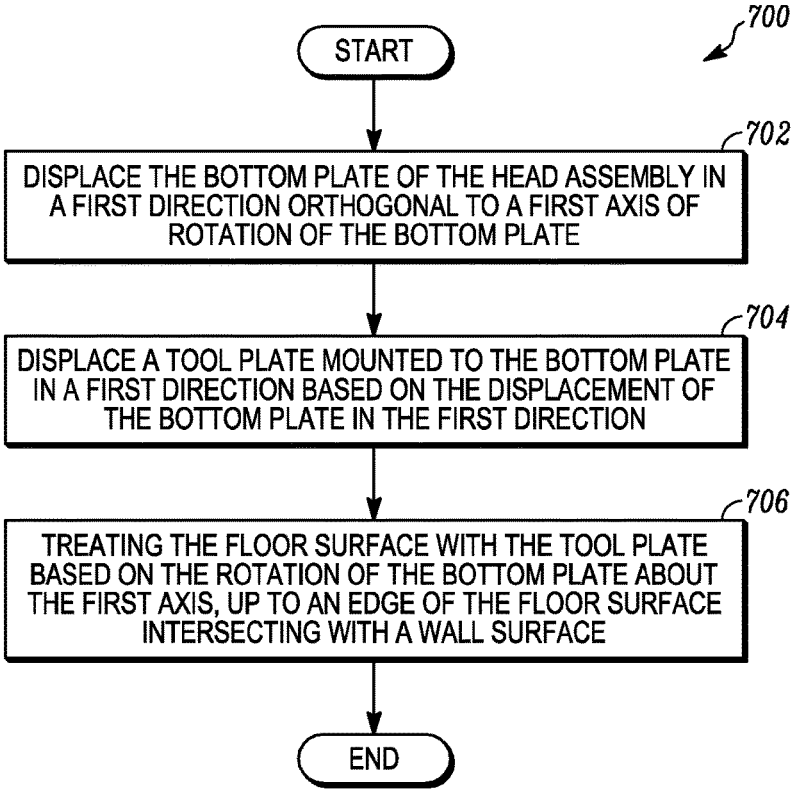
FIG. 7 is a flow diagram that illustrates an example of a method for treating a floor surface, according to an embodiment.

FIG. 7 is a flow diagram that illustrates an example of a method 700 for treating a floor surface using the apparatus 200. In step 702, the bottom plate 226 of the head assembly 224 is displaced in the first direction 230. In step 704, the tool plate 228 mounted to the bottom plate 226 is also displaced in the first direction 230 based on the displacement of the bottom plate 226 in the first direction 230. In step 706, the floor surface is treated with the tool plate 228 based on rotation of the bottom plate 226, where the floor surface is treated up to an edge of the floor surface intersecting with the wall surface. In some embodiments, steps 702, 704 may be omitted.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense. Throughout this specification and the claims, unless the context requires otherwise, the word "comprise" and its variations, such as "comprises" and "comprising," will be understood to imply the inclusion of a stated item, element or step or group of items, elements or steps but not the exclusion of any other item, element or step or group of items, elements or steps. Furthermore, the indefinite article "a" or "an" is meant to indicate one or more of the item, element or step modified by the article. As used herein, unless otherwise clear from the context, a value is "about" another value if it is within a factor of two (twice or half) of the other value. While example ranges are given, unless otherwise clear from the context, any contained ranges are also intended in various embodiments. Thus, a range from 0 to 10 includes the range 1 to 4 in some embodiments.

What is claimed is:

1. An apparatus comprising:

a frame including a machine base plate with at least one slot aligned in a first direction;

a pair of wheels mounted to the frame such that the frame is configured to travel over a floor surface;

a motor mounted to the frame; and a head assembly including a main head shaft and a bottom plate, wherein the bottom plate is operatively coupled to the motor such that the bottom plate is configured to rotate about a first axis and wherein the at least one slot is configured to slidably receive the main head shaft such that the main head shaft is configured to displace in the first direction to displace the bottom plate in the first direction;

wherein the bottom plate is positioned such that a tooling plate mounted to the bottom plate is configured to treat the floor surface including an edge of the floor surface intersecting a wall surface based on rotation of the bottom plate about the first axis;

wherein the apparatus is configured to displace the bottom plate in the first direction orthogonal to the first axis such that the tooling plate mounted to the bottom plate is displaced in the first direction.

2. The apparatus of claim 1, further including a shroud secured to a perimeter of the frame, wherein an outer diameter of the tooling plate is less than an inner diameter of the shroud;

and wherein the apparatus is configured to displace the bottom plate along the first direction from a first position to a second position such that the tooling plate extends to the shroud in the second position.

3. The apparatus of claim 2, wherein the at least one slot of the machine base plate is a plurality of slots;

wherein the head assembly further includes a plurality of base pins;

and wherein the plurality of slots of the machine base plate slidably receive the main head shaft and the plurality of base pins such that the main head shaft and base pins are configured to displace within the plurality of slots in the first direction to displace the bottom plate in the first direction.

4. The apparatus of claim 1, further including:

an adjuster block on a surface the machine base plate;

a main head shaft bolt to secure the adjuster block to the main head shaft such that the main head shaft is configured to displace in the first direction upon displacement of the adjuster block in the first direction; and an adjuster block bolt operatively connected to the adjuster block such that the adjuster block is configured to displace in the first direction upon rotation of the adjuster block bolt in a clockwise direction and the adjuster block is configured to displace in a second direction opposite to the first direction and orthogonal to the first axis upon rotation of the adjuster block bolt in a counterclockwise direction.

5. The apparatus of claim 4, further including:

an adjuster block bolt tab mounted to the machine base plate, said adjuster block bolt tab including an opening to rotatably mount the adjuster block bolt; and an adjuster block nut positioned within a slot of the adjuster block, wherein the adjuster block nut is rotatably fixed to the adjuster block blot within the slot.

6. The apparatus of claim 5, further including:

an adjuster block nut set screw positioned in an opening in the adjuster block nut and in contact with the adjuster block bolt within the adjuster block nut to rotatably fix the adjuster block nut to the adjuster block bolt; and a plurality of alignment indicators including at least one indicator on the adjuster block and a plurality of indicators on the machine base plate;

wherein upon displacement of the bottom plate along the first direction from a first position to a second position, the at least one indicator on the adjuster block is aligned with a first indicator on the machine base plate when the bottom plate is in the first position and the at least one indicator on the adjuster block is aligned with a second indicator on the machine base plate when the bottom plate is in the second position.

7. An apparatus comprising:

a frame including an upper frame and a lower frame that are pivotally coupled about a pivot axis and wherein the upper frame is configured to be pivoted relative to the lower frame such that the bottom plate is oriented parallel to the floor surface;

a pair of wheels mounted to the lower frame such that the frame is configured to travel over a floor surface;

a motor mounted to the frame; and a head assembly mounted to the upper frame and including a bottom plate, wherein the bottom plate is operatively coupled to the motor such that the bottom plate is configured to rotate about a first axis;

wherein the bottom plate is positioned such that a tooling plate mounted to the bottom plate is configured to treat the floor surface including an edge of the floor surface intersecting a wall surface based on rotation of the bottom plate about the first axis;

wherein the apparatus is configured to displace the bottom plate in the first direction orthogonal to the first axis such that the tooling plate mounted to the bottom plate is displaced in the first direction.

8. The apparatus of claim 7, further comprising:

a first bolt mounted to the upper frame, wherein the first bolt includes external threads oriented in a first direction;

a second bolt mounted to the lower frame, wherein the second bolt includes external threads oriented in a second direction opposite to the first direction; and a height adjuster nut with internal threads, wherein a first end of the height adjuster nut receives the external threads of the first bolt and a second end of the height adjuster nut opposite the first end receives the external threads of the second bolt;

wherein rotation of the height adjuster nut is configured to displace the first bolt and the second bolt in opposing directions and pivot the upper frame relative to the lower frame.

9. The apparatus of claim 7, wherein the upper frame includes a machine base plate and a swivel plate, wherein the head assembly is mounted to the machine base plate and wherein the swivel plate is mounted to the lower frame;

and wherein the machine base plate is configured to pivot with respect to the swivel plate and the lower frame such that the machine base plate and bottom plate are oriented at an angle that is offset from the lower frame.

10. The apparatus of claim 9, wherein the machine base plate includes a plurality of swivel slots and a plurality of swivel locks positioned within the swivel slots, wherein the swivel locks are configured to rotatably fix the machine base plate with respect to the swivel plate;

and wherein upon loosening the swivel locks, the machine base plate is configured to rotate with respect to the swivel plate from a first angular position to a second angular position and wherein the machine base plate is rotatably fixed in the second angular position upon locking the swivel locks.

11. The apparatus of claim 10, wherein a perimeter of the machine base plate and the swivel plate each includes a plurality of grooves, wherein the plurality of grooves of the machine base plate are aligned with the plurality of grooves of the swivel plate when the machine base plate is in the first angular position or the second angular position.

12. An apparatus comprising:

a frame including an upper frame and a lower frame;

a pair of wheels mounted to the lower frame such that the frame is configured to travel over a floor surface;

a motor mounted to the upper frame; and a head assembly mounted to the upper frame, said head assembly including a bottom plate, wherein the bottom plate is operatively coupled to the motor such that the bottom plate is configured to rotate about a first axis;

wherein a tooling plate mounted to the bottom plate is configured to treat the floor surface upon rotation of the bottom plate about the first axis;

wherein the upper frame and the lower frame are pivotally coupled about a pivot axis and wherein the upper frame is configured to be pivoted relative to the lower frame such that the bottom plate is oriented parallel to the floor surface.

13. The apparatus of claim 12, wherein the upper frame is configured to be pivoted relative to the lower frame based on a thickness of the tooling plate mounted to the bottom plate.

14. The apparatus of claim 12, further comprising:

a first bolt mounted to the upper frame, wherein the first bolt includes external threads oriented in a first direction;

a second bolt mounted to the lower frame, wherein the second bolt includes external threads oriented in a second direction opposite to the first direction; and a height adjuster nut with internal threads, wherein a first end of the height adjuster nut receives the external threads of the first bolt and a second end of the height adjuster nut opposite the first end receives the external threads of the second bolt;

wherein rotation of the height adjuster nut is configured to displace the first bolt and the second bolt in opposing directions and pivot the upper frame relative to the lower frame.

15. The apparatus of claim 12, wherein the tooling plate is at least one of a metal bond diamond tooling plate, a resin bond diamond tooling plate, a burnishing pad, a scrub brush and a quick change tooling plate.

16. A method for operating an apparatus to treat a floor surface, wherein the apparatus includes a frame, a pair of wheels mounted to the frame, a motor mounted to the frame, a head assembly including a bottom plate, wherein the bottom plate is operatively coupled to the motor such that the bottom plate is configured to rotate about a first axis, wherein a shroud with a first diameter is secured to a perimeter of the frame, wherein the tooling plate has a first diameter that is less than the first diameter of the shroud, wherein the method comprises:

treating the floor surface with a tooling plate mounted to the bottom plate based on the rotation of the bottom plate about the first axis, wherein the treating step extends to an edge of the floor surface intersecting with a wall surface;

removing the tooling plate from the bottom plate;

detaching a vacuum hose from the shroud with the first diameter;

removing the shroud with the first diameter from the frame;

securing a shroud with a second diameter to the frame;

attaching the vacuum hose to the shroud with the second diameter; and mounting a tooling plate with a second diameter to the bottom plate;

wherein the second diameter is different than the first diameter.

17. The method of claim 16, further comprising:

displacing the bottom plate in a first direction orthogonal to the first axis; and displacing the tooling plate in the first direction based on the displacing of the bottom plate in the first direction.

* * * * *